US006080044A

United States Patent [19]

Lanham et al.

[11] Patent Number: 6,080,044

[45] Date of Patent: Jun. 27, 2000

[54] FINING/POLISHING MACHINE

[75] Inventors: Brian A. Lanham; Harry K. Seim; Fred A. Haddock; Steven C. Schneidewent, all of Muskogee, Okla.

[73] Assignee: Gerber Coburn Optical, Inc., South Windsor, Conn.

[21] Appl. No.: 09/048,460

[22] Filed: Mar. 26, 1998

[51] Int. Cl.[7] ..... B24B 1/00; B24B 7/30

[52] U.S. Cl. ..... 451/42; 451/277

[58] Field of Search ..... 451/92, 277, 272, 451/42, 43

[56] References Cited

U.S. PATENT DOCUMENTS

| | | | |
|---|---|---|---|
| 3,187,469 | 6/1965 | Slack et al. | 51/58 |
| 3,732,647 | 5/1973 | Stith | 51/54 |
| 3,769,762 | 11/1973 | Mayo | 51/284 |
| 3,863,395 | 2/1975 | Brown | 51/121 |
| 3,893,264 | 7/1975 | Behnke | 51/119 |
| 4,135,890 | 1/1979 | Billault | 51/124 L |
| 4,653,233 | 3/1987 | Brueck | 51/124 |
| 5,027,560 | 7/1991 | Coburn et al. | 51/124 L |
| 5,138,798 | 8/1992 | Volat | 51/124 L |
| 5,140,782 | 8/1992 | Mecteau et al. | 51/284 R |
| 5,231,587 | 7/1993 | Frost | 364/474.06 |
| 5,345,725 | 9/1994 | Anthony | 451/390 |
| 5,421,770 | 6/1995 | Bobst | 451/390 |
| B1 3,732,647 | 2/1986 | Stith | 51/54 |

FOREIGN PATENT DOCUMENTS

| | | | |
|---|---|---|---|
| WO 89/09680 | 10/1989 | France | 451/42 |

*Primary Examiner*—Rodney Butler
*Attorney, Agent, or Firm*—Frank J. Catalano

[57] ABSTRACT

A machine for fining/polishing ophthalmic lenses has a horizontal and vertical plates rigidly fixed in an inverted T. Eccentric shafts journalled 180 degrees out of phase on the horizontal plate orbit tools on one side of the vertical plate. A swing frame pivotally mounted on the other side of the vertical plate has a horizontal shaft parallel to the vertical plate. Shafts orthogonal to the horizontal shaft are journalled for see-saw motion about the horizontal shaft, for rotational motion about their own longitudinal axes and for sliding motion along the horizontal shaft. Block adapters on the orthogonal shafts hold lenses in vertical alignment above the tools. Separate linkages reciprocate the horizontal shaft in parallel relationship to the vertical plate and the orthogonal shafts in orthogonal relationship to the vertical plate. The shaft linkages have a timing ratio such that the block adapters travel in laterally reciprocating horizontal figure eight patterns. The orthogonal shafts are adapted for independent adjustment to permit horizontal and vertical realignment of the block adapters. Air cylinders see-saw the orthogonal shafts to maintain a desired pressure between the tools and lenses. A microprocessor storing data representative of appropriate times of operation of the machine and pressures between the tools and lenses for a plurality of lens materials and fining/polishing operations automatically sets and controls the time of operation of the machine and the pressure between the tools and lenses in response to input in directing the material of the lens to be fined/polished and the selected fining/polishing operation.

9 Claims, 23 Drawing Sheets

FINING/POLISHING MACHINE

BACKGROUND OF THE INVENTION

This invention relates generally to machines used in making ophthalmic lenses and more particularly concerns machines used to fine and polish ophthalmic lenses.

In presently known fining/polishing machines which simultaneously fine or polish two lenses, the motion of the block adapters is achieved by the use of separate swing frames for each adapter and separate drive mechanisms for each swing frame. To accommodate the multiple frames and drive components, these machines require a relatively large foot print. They are difficult to maintain in calibration. They are configured for material specific cycles and reconfiguration requires time and pressure adjustments to be made manually by the operator.

It is, therefore, an object of this invention to provide a fining/polishing machine suitable for simultaneously fining or polishing two lenses. Another object of this invention is to provide a fining/polishing machine having its calibrated components mounted on a single rigid frame. It is also an object of this invention to provide a fining/polishing machine having two block adapter assemblies mounted on a single swing frame. A further object of this invention is to provide a fining/polishing machine capable of simultaneously fining or polishing two lenses by use of a single drive motor. Yet another object of this invention is to provide a fining/polishing machine with computerized controls enabling an operator to automatically set machine operating parameters by selecting the material of the lens to be fined/polished. It is also an object of this invention to provide a fining/polishing machine having a computerized process enabling the operator to automatically set cycle times and fining/polishing pressures by selection of the material of the lenses to be fined/polished. A further object of this invention is to provide a fining/polishing machine which is smaller and more economical than known machines performing the same functions.

SUMMARY OF THE INVENTION

In accordance with the invention, a machine for fining/polishing ophthalmic lenses is provided having a horizontal plate and a vertical plate rigidly fixed to and extending upwardly from a midportion of the horizontal plate. A first eccentric shaft is journalled on the horizontal plate for orbiting a first tool about a first vertical axis on one side of the vertical plate and a second eccentric shaft is journalled on the horizontal plate for orbiting a second tool about a second vertical axis on the same side of the vertical plate. The first and second vertical axes are in a plane parallel to the vertical plate. A swing frame is pivotally mounted on the other side of the vertical plate and has a horizontal shaft parallel to the vertical plate. A first shaft orthogonal to the horizontal shaft is journalled for see-saw motion about the horizontal shaft, for rotational motion about its own longitudinal axis and for sliding motion along the horizontal shaft. The first shaft extends through an aperture in the vertical plate with its longitudinal axis intersecting the first vertical axis. A block adapter on the end of the shaft holds a first lens in vertical alignment above the first tool. A second shaft orthogonal to the horizontal shaft is journalled for see-saw motion about the horizontal shaft for rotational motion about its own longitudinal axis and for sliding motion along the horizontal shaft. The second shaft extends through another aperture in the vertical plate with its longitudinal axis intersecting the second vertical axis. A block adapter on the end of the shaft holds a second lens in vertical alignment above the second tool. A first linkage reciprocally moves the horizontal shaft in parallel relationship to the vertical plate and a second linkage simultaneously reciprocally moves the first and second orthogonal shafts in orthogonal relationship to the vertical plate. The horizontal and orthogonal shaft linkages have a timing ratio therebetween such that the first and second block adapters travel in a horizontal figure eight pattern aligned with the first and second orthogonal shafts and reciprocating in a direction parallel to the vertical plate.

The lens holding ends of the first and second orthogonal shafts are adapted for independent adjustment of their lengths to permit horizontal realignment of the block adapters. The lens holding ends of the first and second orthogonal shafts are also adapted for independent adjustment to permit vertical realignment of the block adapters. This facilitates easy adjustment and synchronization of the machine.

Preferably, the timing ratio provides slightly more than two reciprocations of the horizontal shaft for each reciprocation of the orthogonal shafts. It is also preferred that the eccentric axes of the first and second tools rotate 180 degrees out of phase and that the first and second orthogonal shafts slide in the same direction. First and second air cylinders connected to opposite ends of the first and second orthogonal shafts as the lens holding means cause the first and second orthogonal shafts to see-saw to maintain a desired pressure between the tools and the lenses. A microprocessor has data stored therein representative of appropriate times of operation of the machine and pressures between the tools and lenses for a plurality of lens materials and fining/polishing operations. The microprocessor automatically sets and controls the time of operation of the machine and the pressure between the tools and lenses in response to input to the microprocessor of the materials of the lens to be fined/polished and the selected fining/polishing operation.

The horizontal and vertical plate fixed reference relationship avoids calibration problems experienced with previous machines. The use of a single swing frame with a single drive linkage and separately alignable block adapters allows for a smaller machine footprint than previous double linkage machines, reducing machine width by more than 25 percent.

Computer control results in faster and more accurate operation than the operator controlled time and pressure parameters for each material as in previous machines, saving approximately thirty seconds in a 120 to 240 second process.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
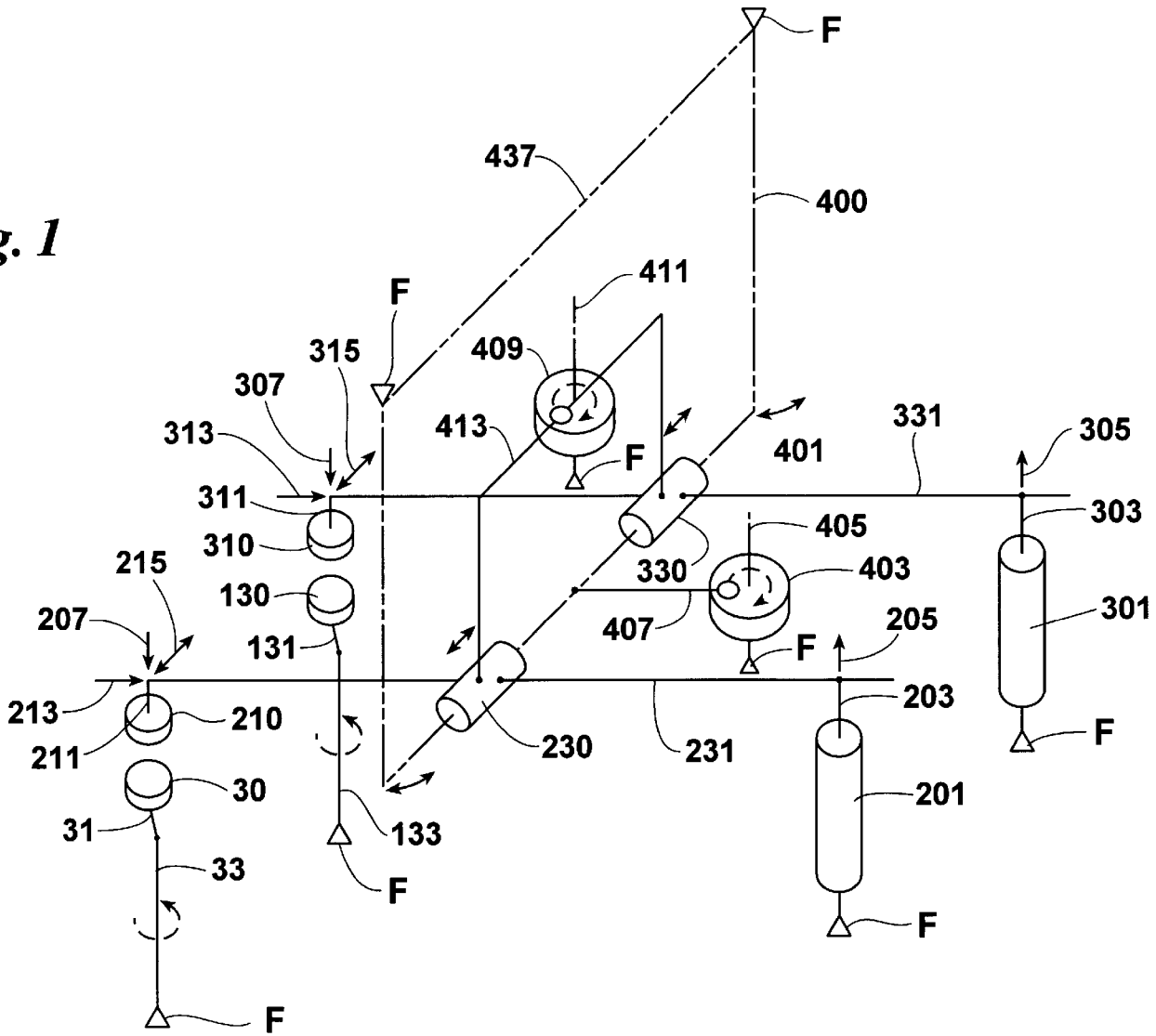
FIG. 1 is a schematic diagram of a preferred embodiment of the fining/polishing machine.

Turning first to FIG. 1, a preferred embodiment of the fining/polishing machine is diagrammatically illustrated. Right and left lap apron assemblies 30 and 130 are used to fine/polish lenses (not shown) chucked to right and left block adapter assemblies 210 and 310. The lap apron assemblies 30 and 130 are orbited on right and left lap eccentric axes 31 and 131 which intersect right and left lap rotational axes 33 and 133, the rotational axes 33 and 133 being vertically aligned on the machine frame F in a common plane. The block adapter assemblies 210 and 310 are centered on right and left block adapter central axes 211 and 311 which are vertically aligned with the rotational axes 33 and 133 of the lap apron assemblies 30 and 130. The block adapter assemblies 210 and 310 are driven in horizontal figure eight patterns taken in relation to the front and rear directions 213 and 313 of the machine, the figure eight patterns being reciprocated in lateral directions 215 and 315 with respect to the machine. The reciprocating horizontal figure eight patterns of motion are accomplished by the use of right and left rocker housing assemblies 230 and 330 which are mounted on a swing frame 400 assembly on a common horizontal lateral axis 401 parallel to the plane of the rotational axes 33 and 133 of the lap apron assemblies 30 and 130. The swing frame 401 is pivotally mounted on the machine frame F so that the horizontal axis 401 can be arcuately reciprocated in relation to the plane of the lap apron assembly rotational axes 33 and 133. A swing disk 403 is rotationally driven about a swing eccentric rotational axis 405 and a swing linkage 407 is connected between the swing frame horizontal axis 401 and an eccentric point on the swing disk 403 to cause the axis 401 to reciprocate arcuately over a small distance to produce a substantially horizontal motion in the front and rear directions 213 and 313. A slide disk 409 is rotatively driven about a slide eccentric rotational axis 411 and is eccentrically connected by a slide linkage 413 to the rocker housing assemblies 230 and 330, causing the rocker housing assemblies 230 and 330 to reciprocate laterally along the swing frame horizontal axis 401 to produce substantially horizontal movement in the lateral direction 213 and 315. The rotational axes 405 and 411 of the swing and slide disks 403 and 409 are vertically fixed in relation to the machine frame F. The combination of motions imparted to the rocker housing assemblies 230 and 330 by the swing disk 403 and the slide disk 409 together with a timing ratio between the disks 403 and 409 which is not equal to unity results in the horizontal reciprocating figure eight patterns of motion hereinbefore discussed. The orbiting of the lap apron assemblies 30 and 130 and the rotation of the disks 403 and 409 are achieved by the use of a single drive motor with appropriate timing belts and pulleys to establish the desired timing ratio, as will hereinafter be explained. To provide suitable fining/polishing force to the lenses, the block adapter assemblies 210 and 310 are slidably engaged to right and left block adapter cylinders 201 and 301 which are fixed to the machine frame F. The cylinders 201 and 301 have shafts 203 and 303 which are adapted to slidably receive shafts of their respective rocker housing assemblies 230 and 330 on the opposite side of the rocker housing assemblies 230 and 330 from the block adapter assemblies 210 and 310. Thus, upward forces 205 and 305 exerted on the rocker housing assemblies 230 and 330 by the cylinders 201 and 301 result in downward forces 207 and 307 being exerted on the block adapter assemblies 210 and 310 to maintain the necessary forces to properly fine/polish the lenses.

Figure 2:
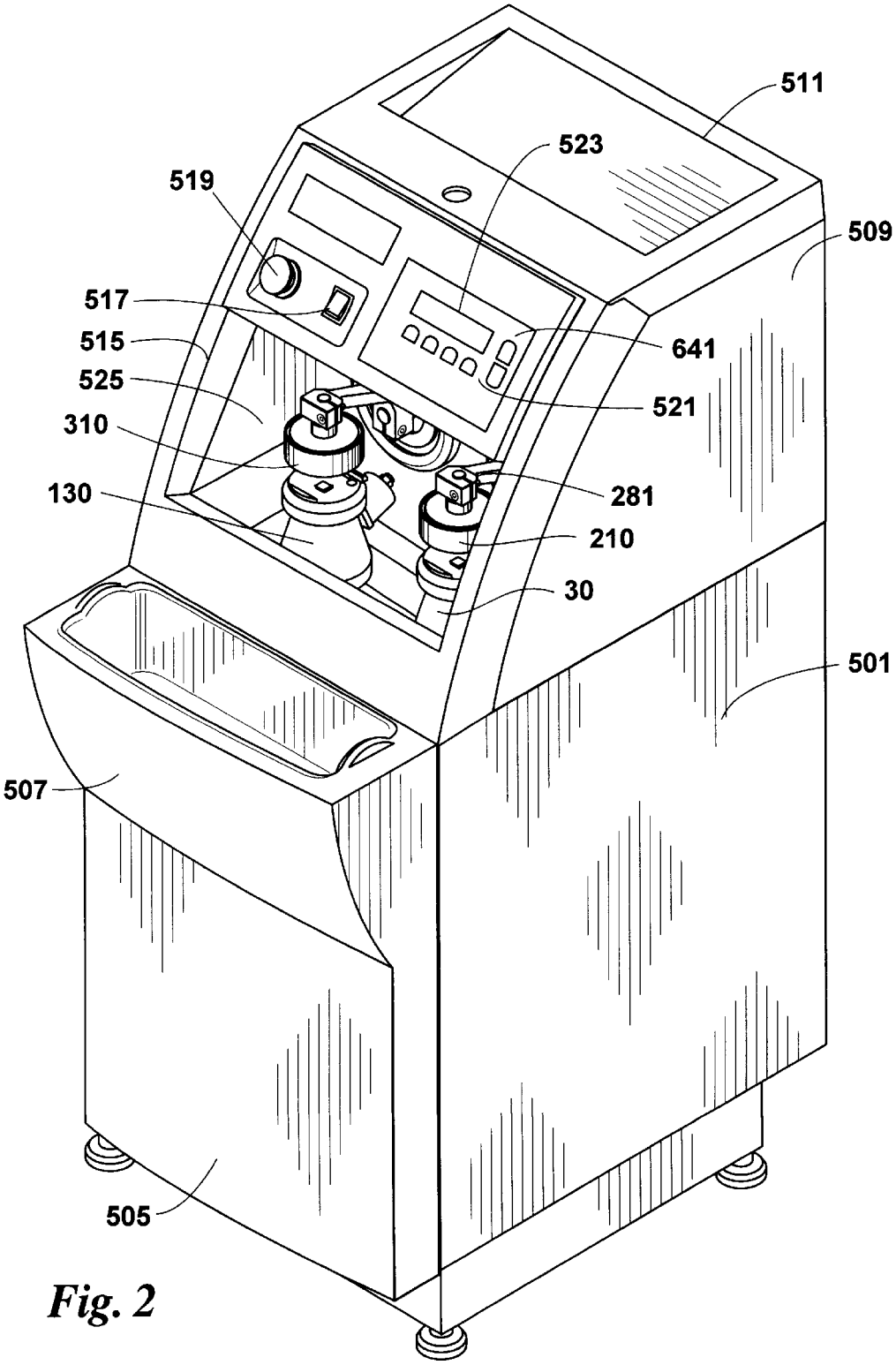
FIG. 2 is a perspective view of the machine of FIG. 1 fully assembled.
Figure 3:
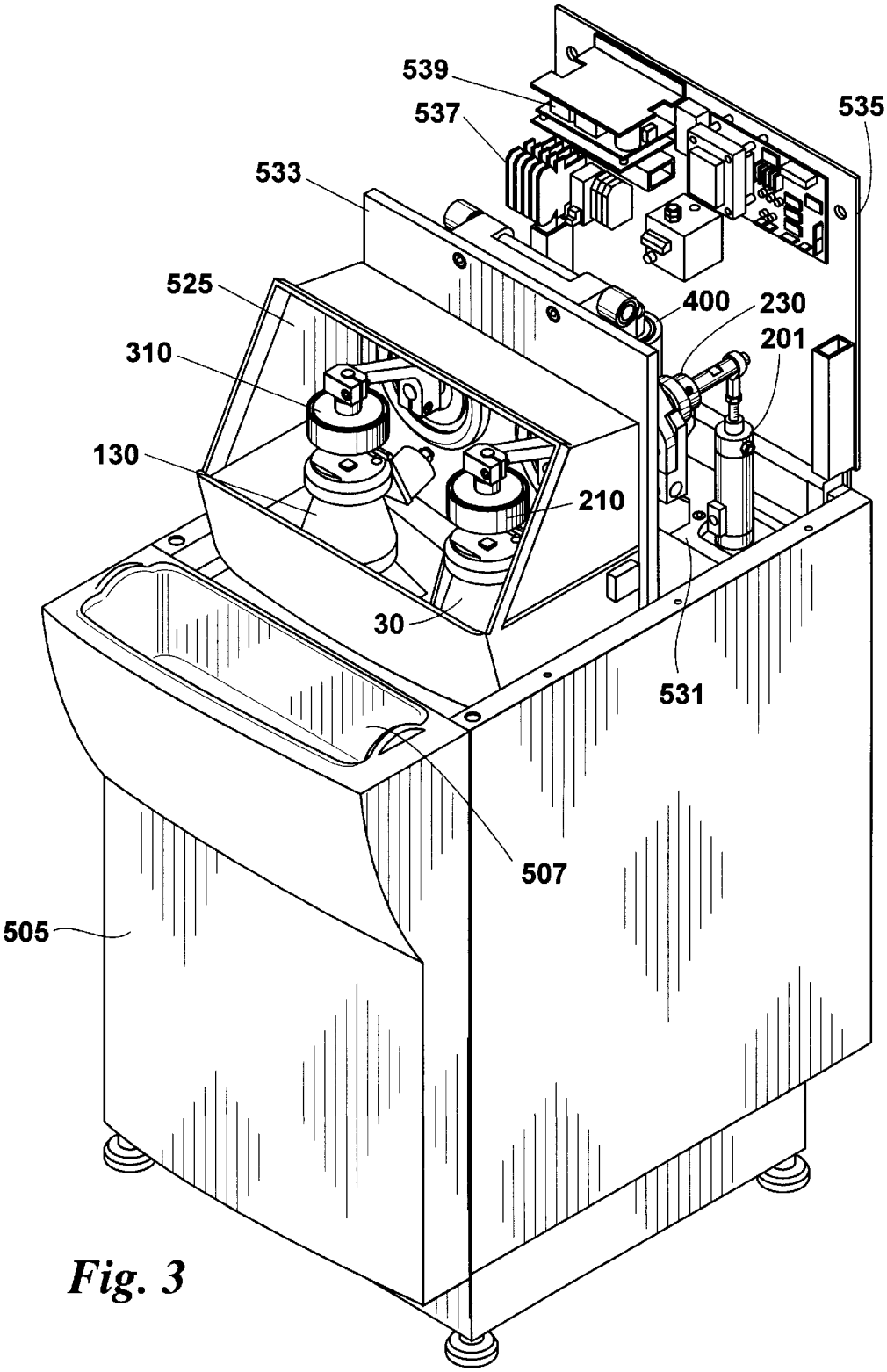
FIG. 3 is a front perspective view of a preferred embodiment of the upper portion of the machine of FIG. 2 with the top cover removed.
Figure 4:
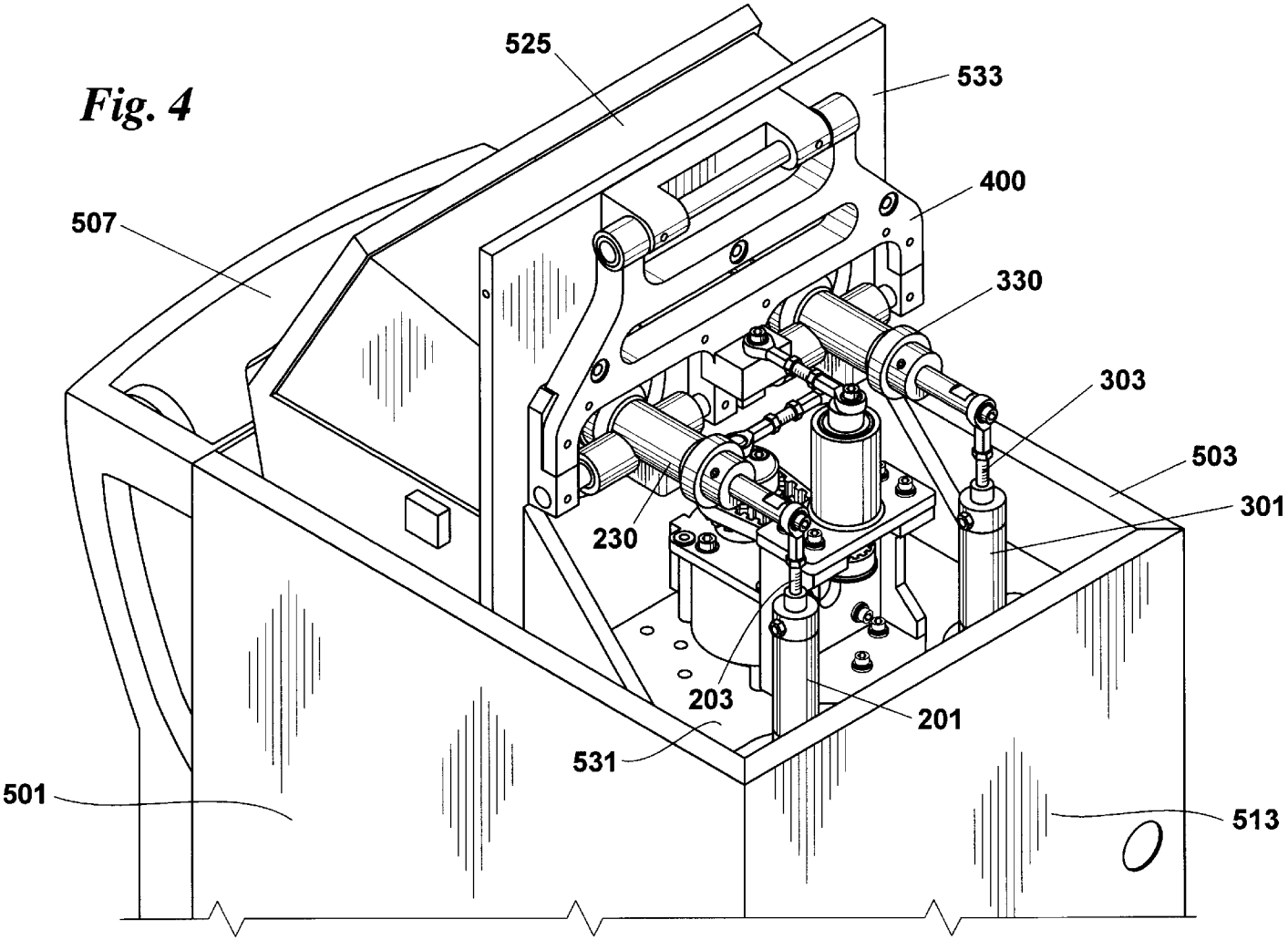
FIG. 4 is a rear perspective view of a preferred embodiment of the upper portion of the machine of FIG. 2 with the top cover removed.

Looking now at FIGS. 2, 3 and 4, a preferred embodiment of the fining/polishing machine is shown. The machine includes a floor mounted cabinet having side panels 501 and 503, a lower front door 505 with a built-in rinse basin 507 on its upper end and a top cover 509 including a tray 511 seated on top of the cover 509. The lower rear portion of the machine is closed by a back panel 513. The front cover 509 is provided with an access opening 515 extending across and above the rinse basin 507. Above and to the left of the access door are the main power switch 517 and the emergency stop switch 519 and on the right side of the machine above the access opening 515 are a keyboard 521 and LCD display 523. The access opening 515 opens into the fining/polishing enclosure or slurry bowl 525, giving the operator access to the right and left apron assemblies 30 and 130 and the right and left block adapter assemblies 210 and 310. The slurry bowl 525 is seated on a base plate 531 which extends horizontally substantially from the front to the rear of the machine. The slurry bowl 525 has a bottom drain (not shown) which vents through an opening in the base plate 531 to a reservoir in the lower portion of the cabinet. A slurry source and pump a (not shown) are also contained in the cabinet. A vertically aligned swing frame mounting plate 533 is rigidly fixed to and extends laterally substantially across the width of the base plate 531. The back of the slurry bowl 525 abuts the front of the mounting plate 533. The base plate 531 and mounting plate 533 are the major structural components of the machine frame F. As can best be seen in FIG. 4, the swing frame 400 is mounted on the rear face of the swing frame mounting plate 533. The rocker housing assemblies 230 and 330 are pivoted on the swing frame assembly 400 and the right and left air cylinders 201 and 301 are mounted on a motor mount fixed to the base plate 531 and connected to the rear portions of the rocker housing assembly 230 and 330. A back plate 535 supports the pneumatic and electrical systems 537 and 539 for the machine.

Figure 5:
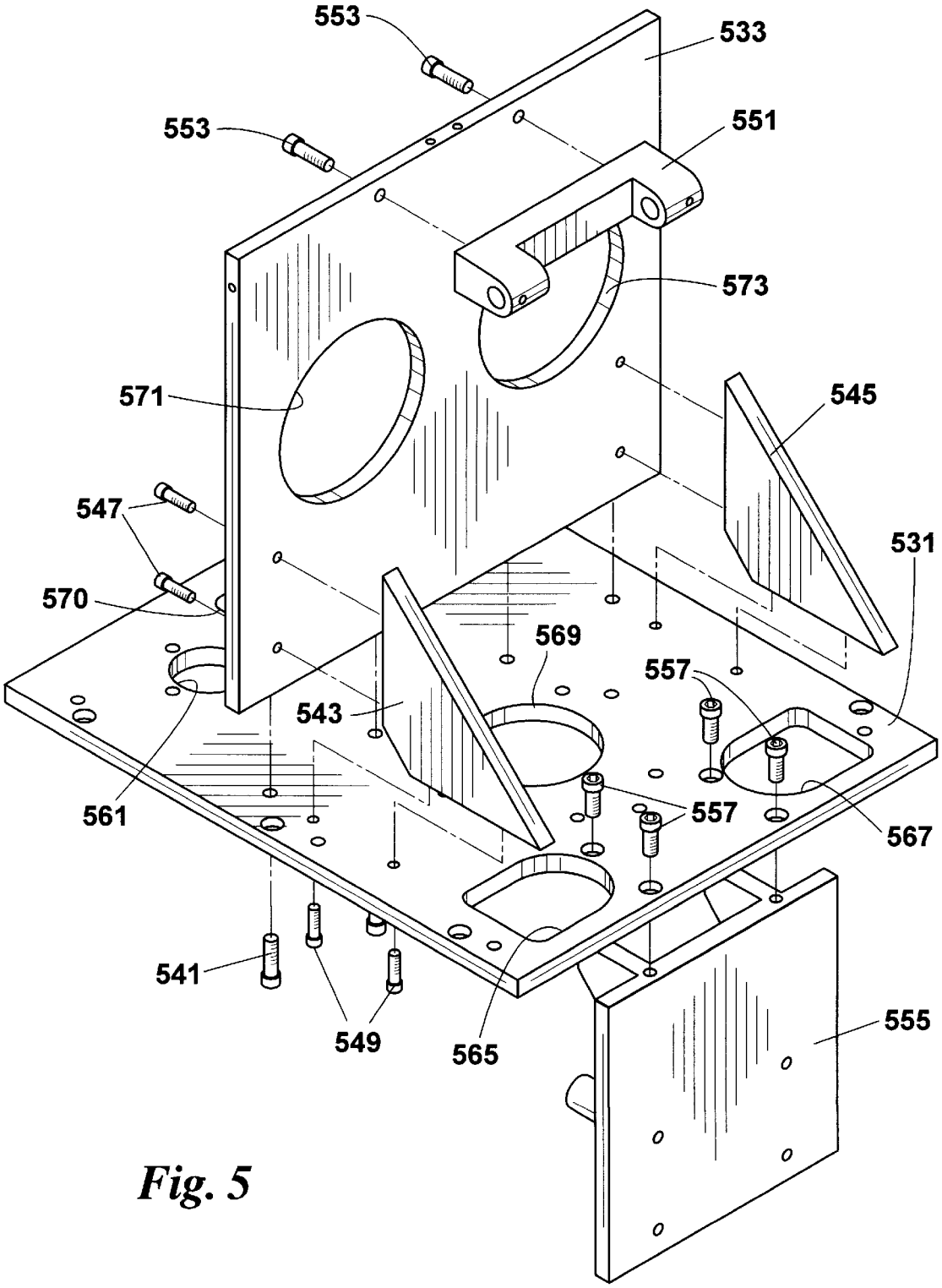
FIG. 5 is a perspective assembly view of a preferred embodiment of the base plate assembly of the machine of FIG. 2.

The main components of the machine frame F are shown in greater detail in FIG. 5. The swing frame mounting plate 533 is fastened to the base plate 531 by screws 541 and reinforced in this position by swing frame support plates 543 and 545 fastened to the mounting plate 533 and to the base plate 531 by screws 547 and 549. A mounting bracket 551 to which the swing frame assembly 400 will be connected is fastened to the upper portion of the mounting plate 533 by screws 553. A motor mount 555 is fastened to the rear bottom face of the base plate 531 by screws 557. Apertures 561 are provided in the front portion of the base plate 531 to accommodate the lap apron assemblies 30 and 130 and apertures 565 and 567 are provided in the rear of the base plate 531 to accommodate the air cylinders 201 and 301. Another aperture 569 in approximately the center rear portion of the base plate 531 accommodates the timing belt pulley 457 of the machine drive motor 451. An aperture 570 through the front central portion of the base plate 531 accommodates connection of the slurry bowl 525 to the slurry source and reservoir in the cabinet below. Finally, apertures 571 and 573 are provided in the mounting plate 533 to accommodate the rocker housing assemblies 230 and 330.

Figure 6:
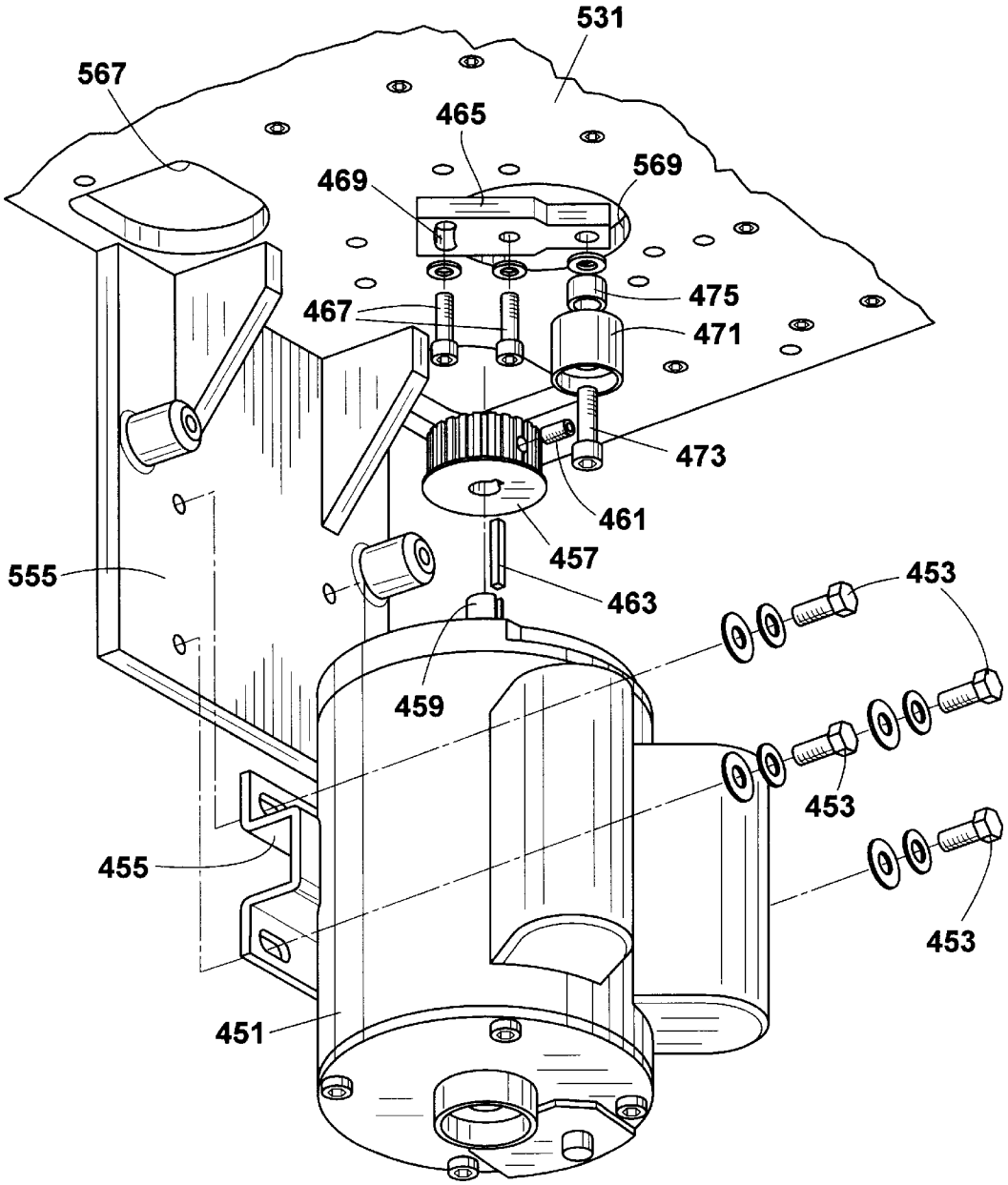
FIG. 6 is a perspective assembly view of a preferred embodiment of the motor mounting assembly of the machine of FIG. 2.

As shown in FIG. 6, the machine main drive motor 451 is connected to the motor mount 555 by a bracket 455 with screws, lock washers and washers 453. The motor 451 is preferably a 3/4 horsepower 120/240 volt A.C. 50/60 cycle motor. The timing belt pulley 457 is fixed to the motor shaft 459 by a set screw 461 and is oriented in relation to the shaft 459 by a shaft key 463. A belt tensioner 465 is fastened to the bottom of the base plate 531 at the timing belt pulley aperture 569 by use of screws and washers 467, one screw extending through a slot 469 which allows the opposite end of the tensioner 465 to be reoriented by rotation of the tensioner 465 about the other screw 467. An idler bearing assembly 471 is mounted to the lower face of the tensioner 465 by a screw 473 and a stand off and washer assembly 475. Thus, the position of the idler bearing assembly 471 can be adjusted by repositioning the slot 469 of the tensioner 465 in relation to the screw 467 extending through the slot 469. The pulley 457 is connected by a belt (not shown) to the lap apron assemblies 30 and 130 below the base plate 531.

Figure 7:
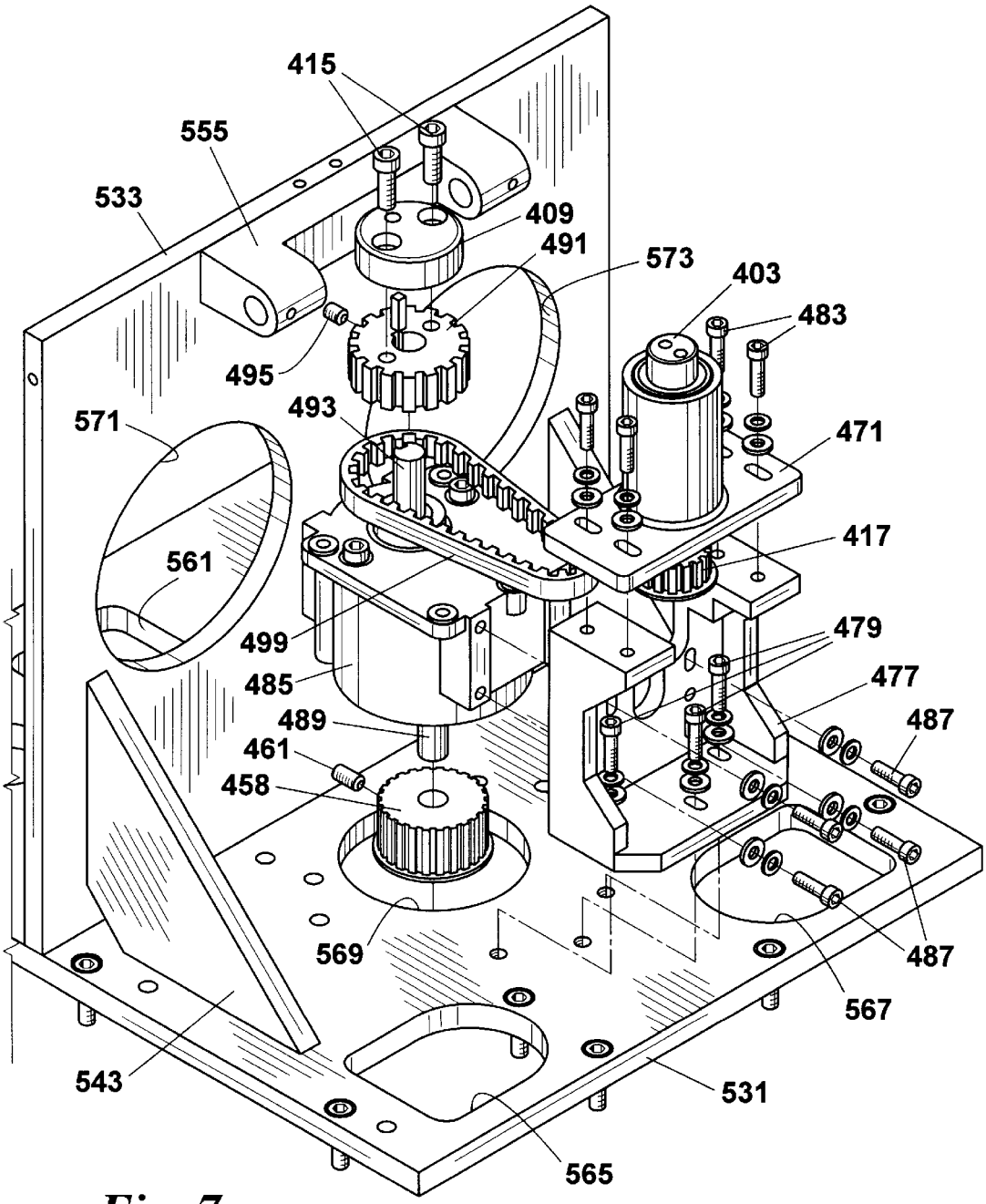
FIG. 7 is a perspective assembly view of preferred embodiments of the speed reducer assembly and spoke spindle assembly of the machine of FIG. 2.

As shown in FIG. 7, a stroke spindle bracket 477 is secured to the base plate 531 by screws and washers 479. A stroke spindle assembly 481 is secured to the top of the bracket 477 by screws and washers 483. A speed reducer 485 is fastened to the front of the bracket 479 by use of screws and washers 487 and the primary shaft 489 of the speed reducer 485 is engaged with a second timing pulley 458. The idler bearing assembly 471 engages the belt (not shown) between the first and second pulleys 457 and 458. A third timing belt pulley 491 is secured to a secondary shaft 493 of the speed reducer 485 by a set screw 495, the pulley 491 being oriented by a shaft key 497. The slide disk 409 is fastened to the pulley 491 by screws 415. The swing disk 403 is mounted on a stroke spindle assembly 401 which is rotatively coupled a fourth timing belt pulley 417 to the speed reducer secondary shaft timing belt pulley 491 by a timing belt 499.

Figure 8:
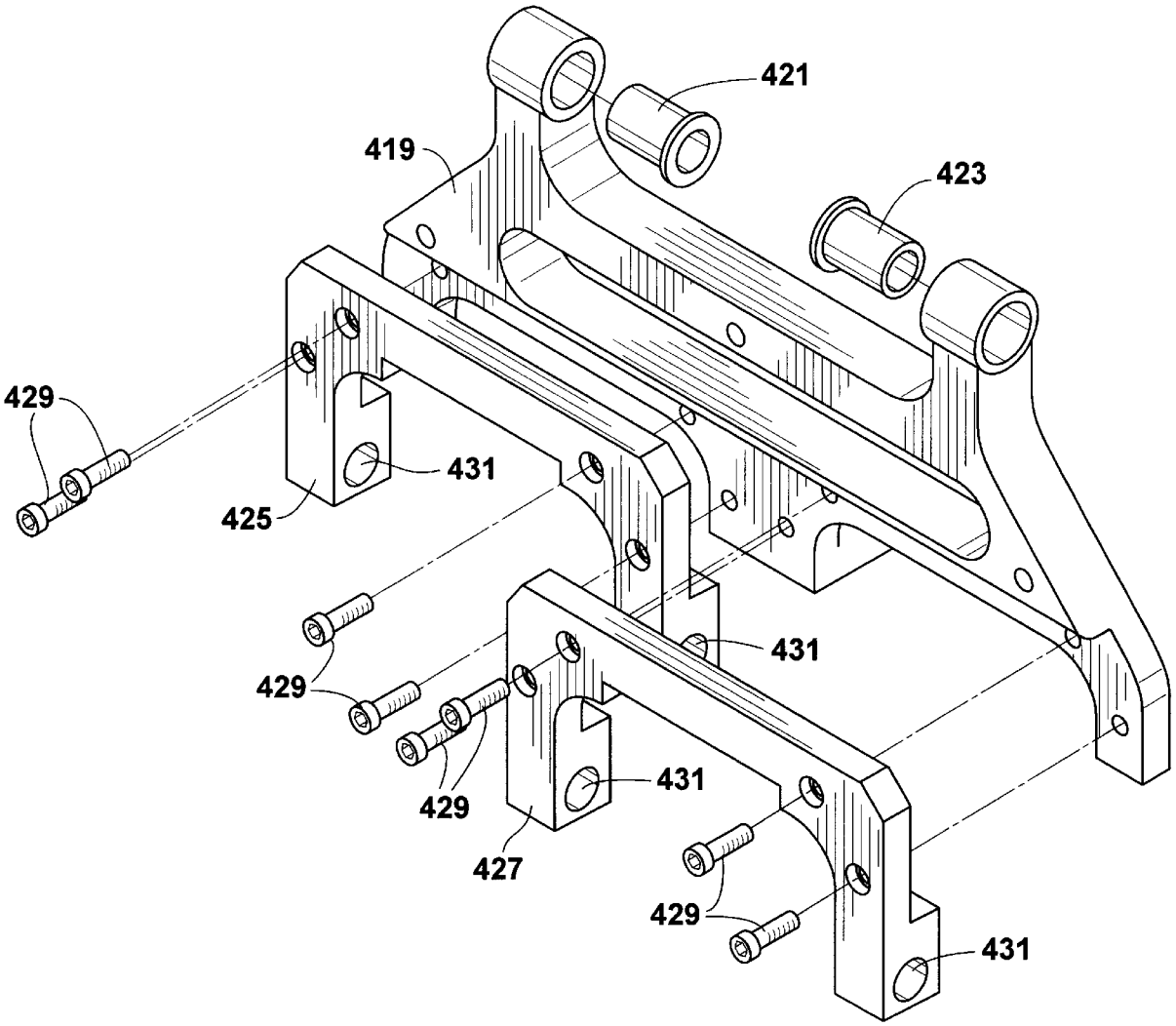
FIG. 8 is a perspective assembly view of a preferred embodiment of the swing frame assembly of the machine of FIG. 2.
Figure 9:
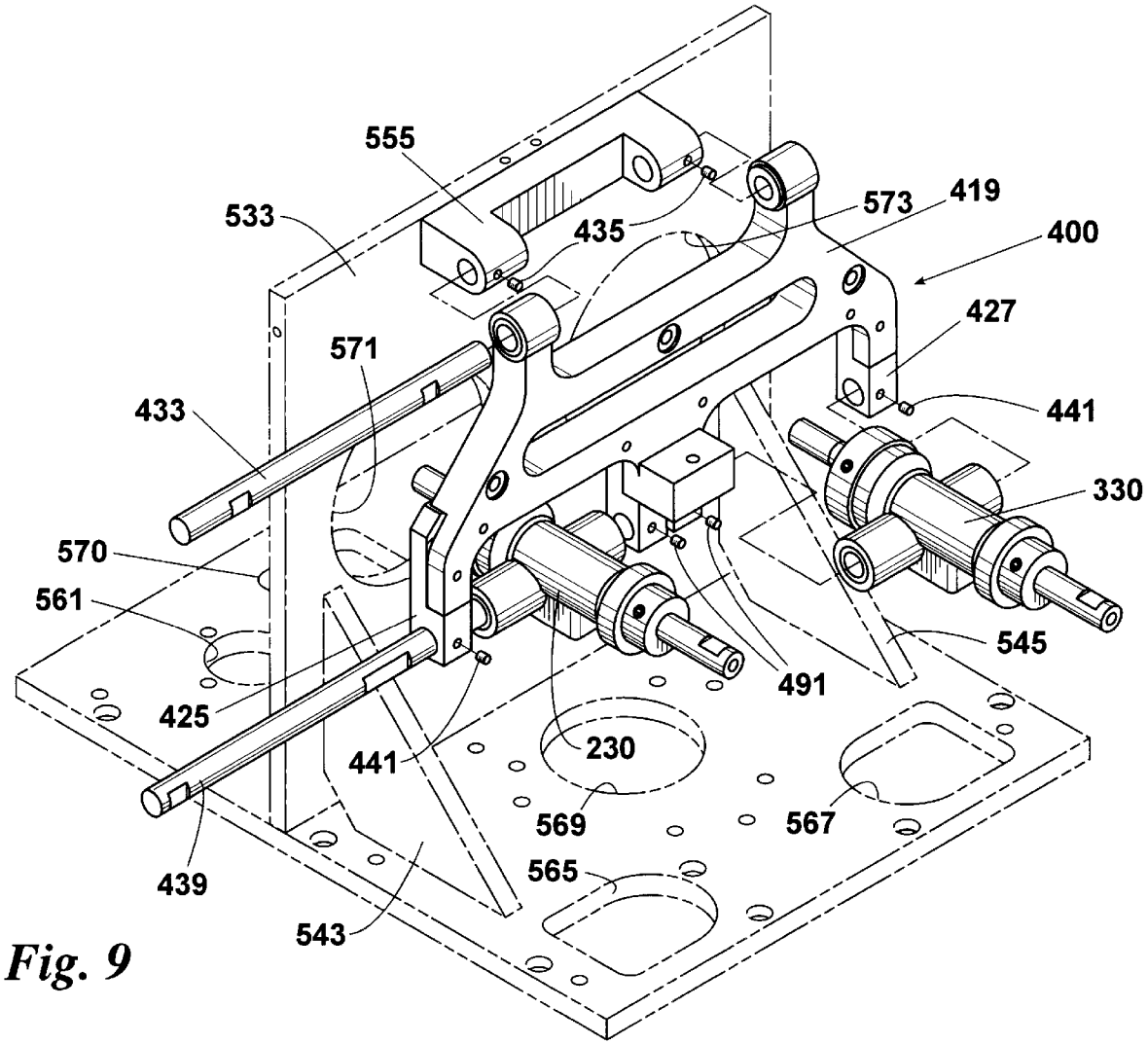
FIG. 9 is a perspective assembly view of the swing frame assembly of FIG. 2 positioned for mounting on the base plate assembly of FIG. 2.
Figure 10:
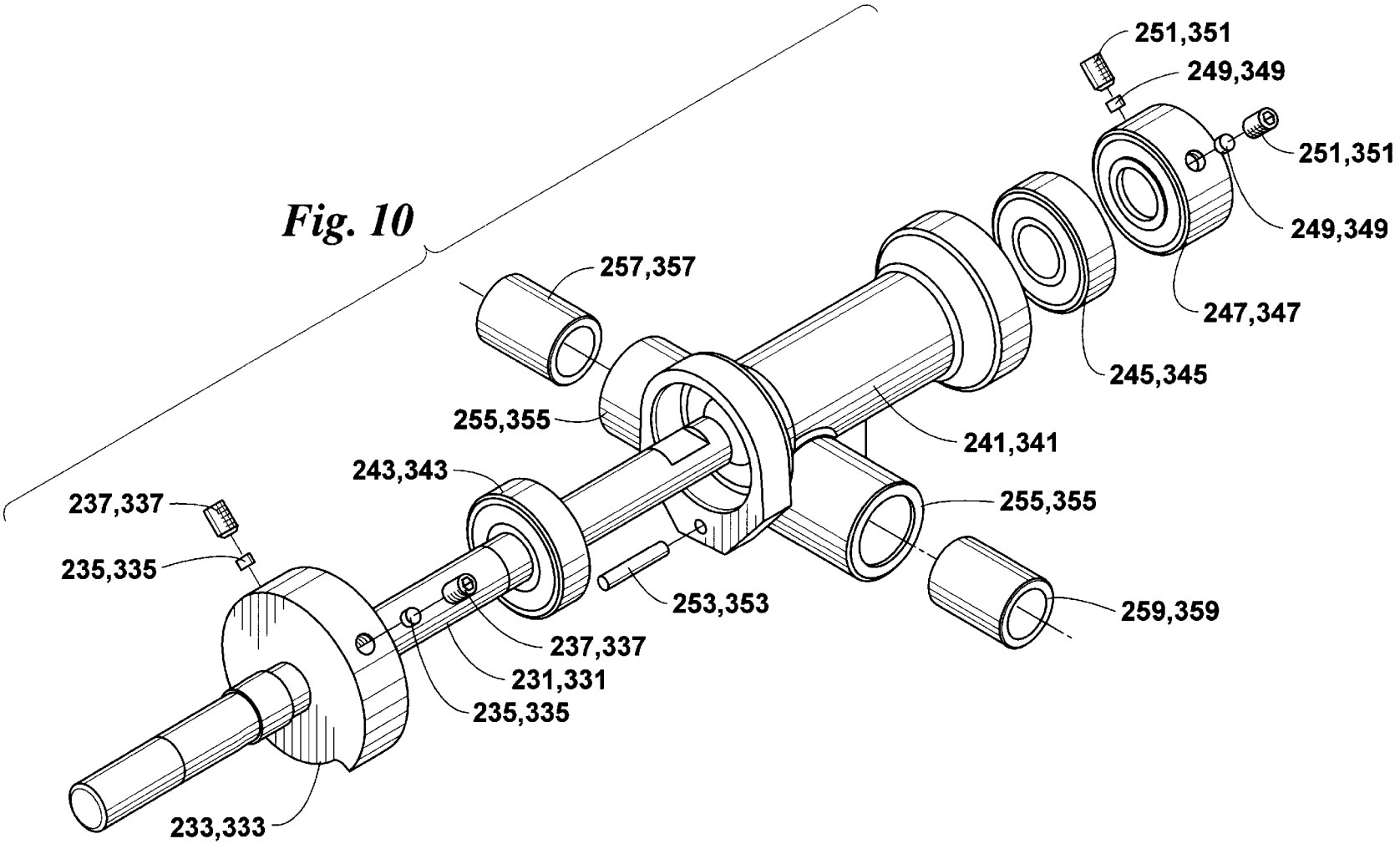
FIG. 10 is a perspective assembly view of a preferred embodiment of the rocker housing assemblies of the machine of FIG. 2.

The swing frame assembly 400 is shown in greater detail in FIG. 8. It consists of an upper member 419 with axially aligned bronze flange bushings 421 and 423. Right and left lower members 425 and 427, respectively, are secured to the bottom portion of the upper member 419 by use of screws 429. The lower members 425 and 427 have axially aligned apertures 431 through their lower portions. Looking at FIG. 9, an upper swing frame shaft 433 extending through the bronze flanges 421 and 423 connects the upper member 419 of the swing frame assembly 400 to the bracket 555 on the swing frame mounting plate 533. Set screws 435 lock the upper swing frame shaft 433 in the bracket 555 and the swing frame assembly 400 is free to rotate on the upper swing frame shaft 433 about the swing frame axis 437 as shown in FIG. 1. The right and left rocker housing assemblies 230 and 330 are aligned in the right and left lower members 425 and 427 of the swing frame assembly 400 and a lower swing frame shaft 439 extends through the apertures 431 in the lower swing frame members 425 and 427 and through transverse cylinders 255 and 355 on the rocker housing assemblies 230 and 330 as shown in FIG. 10. Set screws 441 lock the lower swing frame shaft 439 in the swing frame assembly 400 and the rocker housing assemblies 230 and 330 are free to rotate on the lower swing frame shaft 439 about the swing frame horizontal axis 401 shown in FIG. 1.

The left and right rocker housing assemblies 230 and 330 are illustrated in greater detail in FIG. 10. A rocker shaft 231 or 331 has a limit collar 233 or 333 fixed to its rearward portion by brass soft shoes 235 or 335 held in place by set screws 237 or 337. A rocker housing 241 or 341 slides over the shaft 231 or 331. A ball bearing 243 or 343 is held in the rearward end of the housing 241 or 341 by the limit collar 233 or 333. The forward end of the housing 241 or 341 holds a second ball bearing 245 or 345 through which the shaft 231 or 331 extends. A second limit collar 247 or 347 secures the position of the ball bearing 245 or 345 and the collar 247 or 347 is fixed to the forward end of the shaft 231 or 331 by soft shoes 249 held in place by set screws 251. The housing 241 or 341 is aligned on the shaft 231 or 331 by a spring pin 253 or 353 and a transverse cylindrical section 255 or 355 with bronze bushings 257 or 357 and 259 or 359 in either end. A shown in FIG. 9, the lower swing frame shaft 439 extends through the bushings 257, 259, 357 and 359. Thus, the transverse cylindrical sections 255 and 355 of the housing 241 and 341 are aligned for rotation about the swing frame horizontal axis 401 as shown in FIG. 1. As can best be seen in FIG. 4, the shafts 203 and 303 of the block adapter cylinders 201 and 301 are connected to the rear ends of the rocker housing assembly shafts 231 and 331 to rotate the rocker housing assemblies 230 and 330 about the swing frame horizontal axis 401 and exert the desired force on the block adapter assemblies 210 and 310. The free ends of the shafts 203 and 303 extend into the slurry bowl 525.

Figure 11:
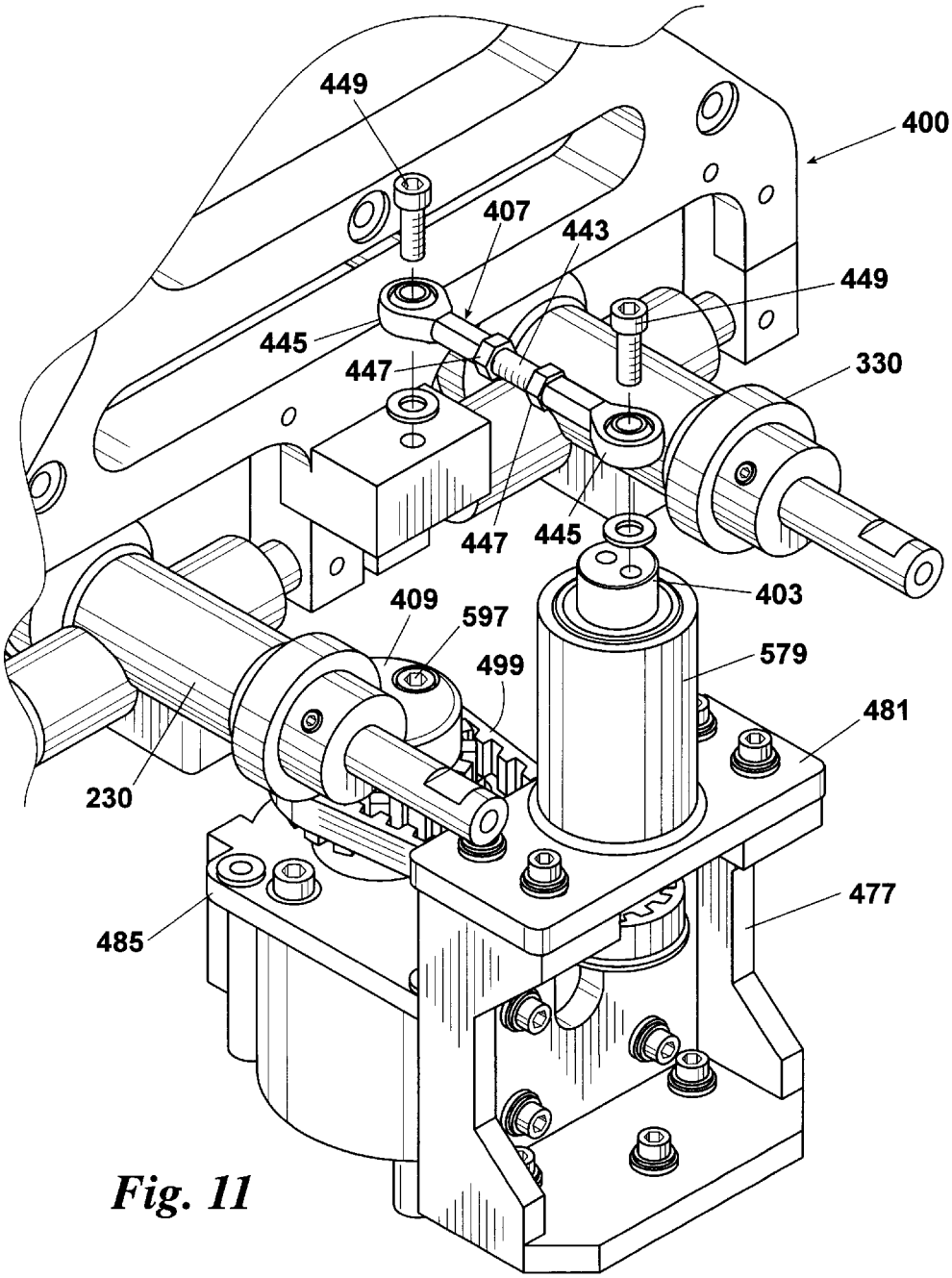
FIG. 11 is a perspective assembly view illustrating a preferred embodiment of the swing linkage of the machine of FIG. 2.
Figure 12:
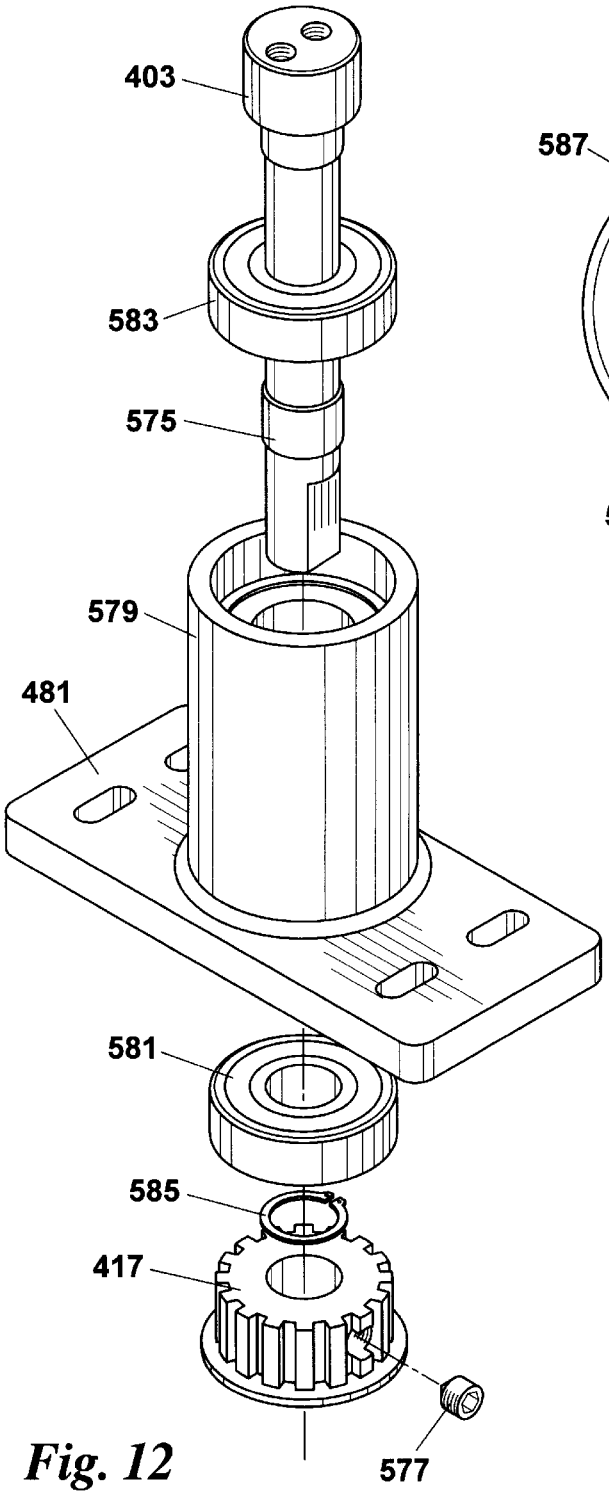
FIG. 12 is a perspective assembly view of a preferred embodiment of the spindle assembly of the machine of FIG. 2.
Figure 13:
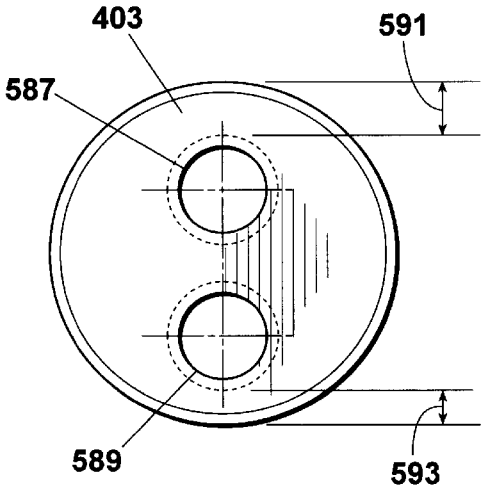
FIG. 13 is a top plan view of a preferred embodiment of the swing disk of the machine of FIG. 2.

Looking now at FIGS. 11, 12 and 13, the swing linkage 407 connecting the swing disk 403 to the swing frame assembly 400 is shown in greater detail. The linkage 407 consists of a screw 443 with bearing rods 445 threaded onto each end and fixed in place by jam nuts 447. The bearing rods 445 are rotatively connected to the swing disk 403 and to a block on the swing frame assembly 400 by screws 449. The spindle timing belt pulley 417, also shown in FIG. 7, is fixed to the end of the spindle shaft 575 by a set screw 577. The shaft 575 is mounted for rotation in the spindle housing 579 on ball bearings 581 and 583, the lower ball bearing 581 being held in place by a retaining ring 585. As can best be seen in FIG. 13, the swing disk 403 has two eccentric apertures 587 and 589 for receiving the screw 449. One eccentric aperture 587 is spaced at a greater distance 591 from the perimeter of the disk than the other aperture 589 which is spaced at a smaller distance 593. The eccentric aperture 587 more distant from the perimeter of the disk 403 is used for fining while the other eccentric aperture 589 is used for polishing. It has been found that a fining distance 591 in a range of 0.156 inches is satisfactory while a polishing distance 593 in a range of 0.094 inches results in satisfactory displacements of the swing frame lower shaft 439 of 0.25 inches or 0.187 inches, respectively.

Figure 14:
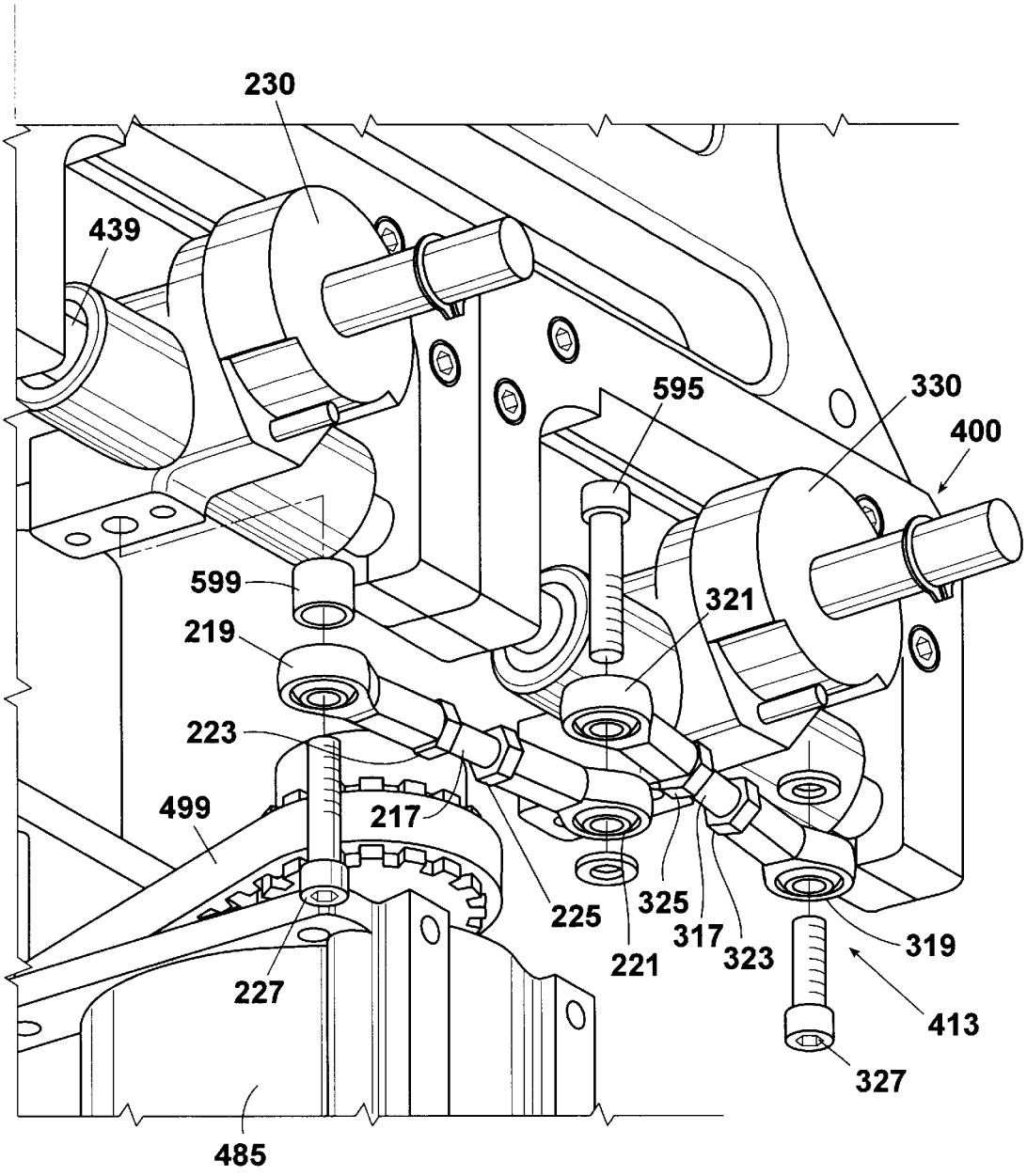
FIG. 14 is a perspective assembly view of a preferred embodiment of the slide linkage of the machine of FIG. 2.
Figure 15:
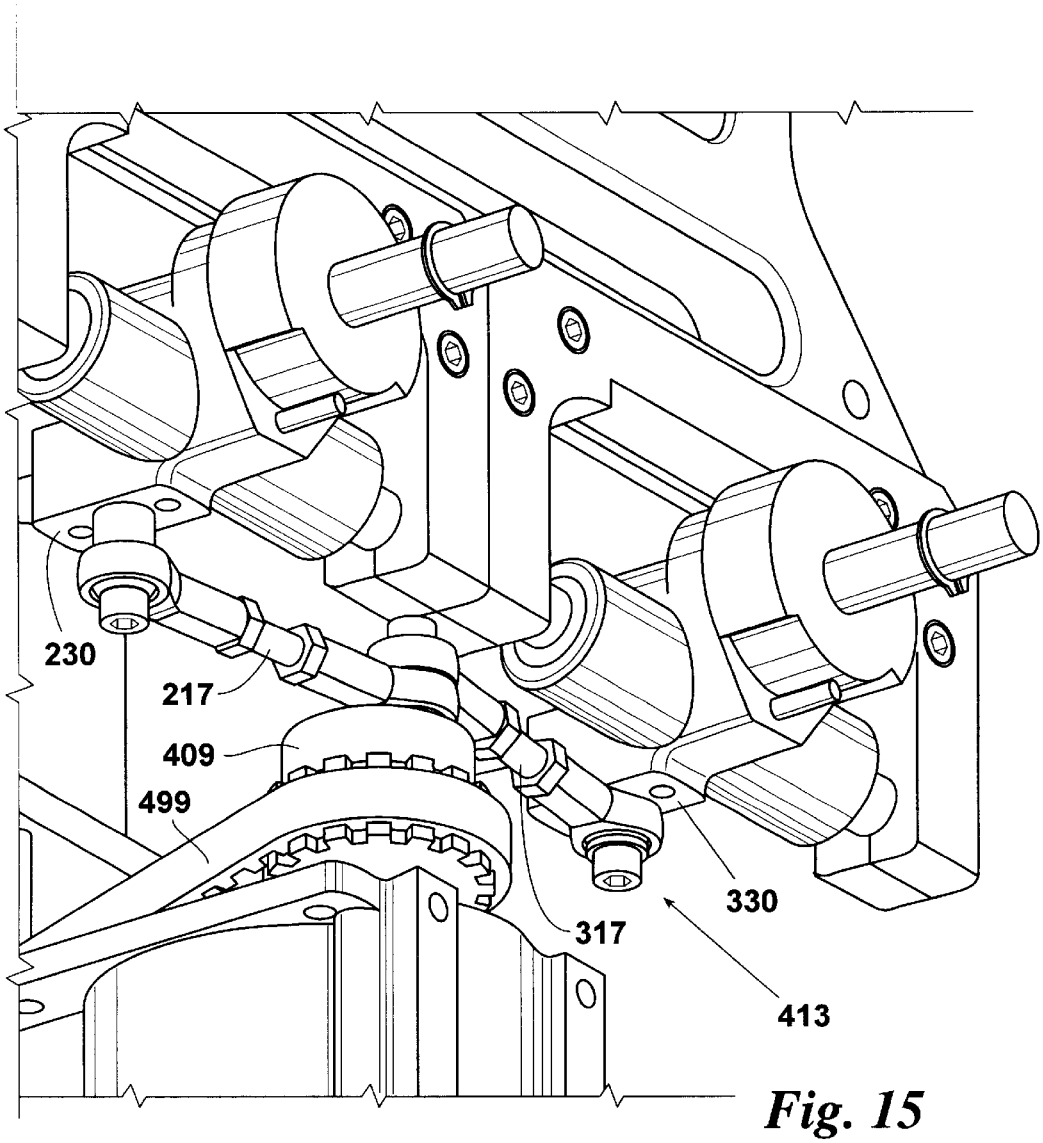
FIG. 15 is a partial perspective view illustrating the assembled slide linkage of FIG. 14.

FIGS. 11, 14 and 15 illustrate the slide linkage 413 used to connect the slide disk 409 to the rocker housing assemblies 230 and 330. A pair of screws 217 and 317 have bearing rods 219 and 319 and 221 and 321 threaded on their ends and adjustably locked in place by jam nuts 223 and 323 and 225 and 325. A screw 595 extends through one bearing rod 221 and 321 of each of the screws 217 and 317. The screw 595 engages the linkage 413 to an aperture 597 in the slide disk 409, as can best be seen in FIG. 11. The other bearing rods 219 and 319 are connected by screws 227 and 327 to the right and left rocker housing assemblies 230 and 330. A bearing spacer 599 adjusts for the stacked relationship of the bearing rods 221 and 321 on the center screws 595. The rocker housing assemblies 230 and 330 move simultaneously in the same lateral direction on the lower swing frame shaft 439.

Figure 16A:
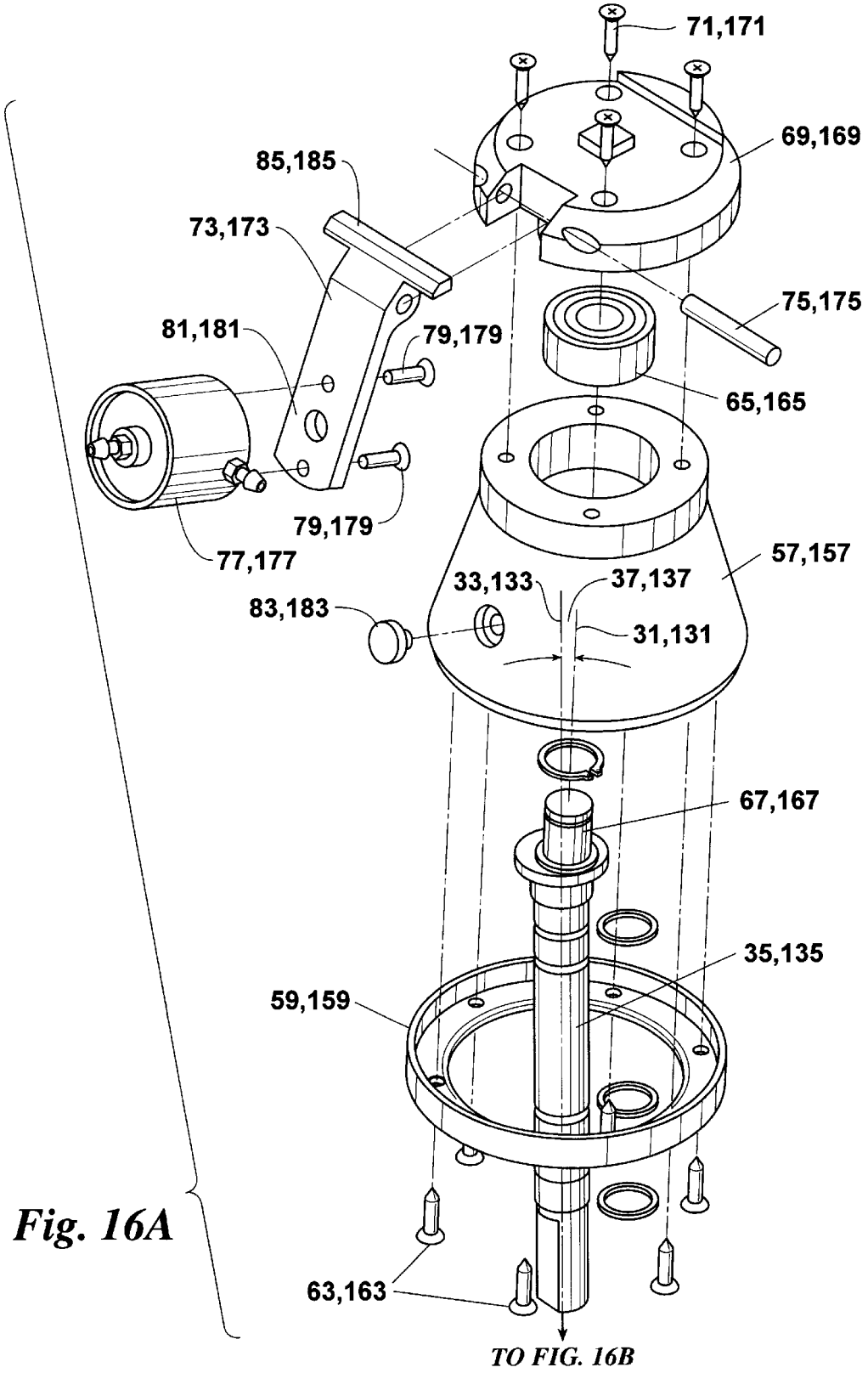
FIG. 16 is a perspective assembly view of a preferred embodiment of the lap apron assemblies of the machine of FIG. 2.
Figure 16B:
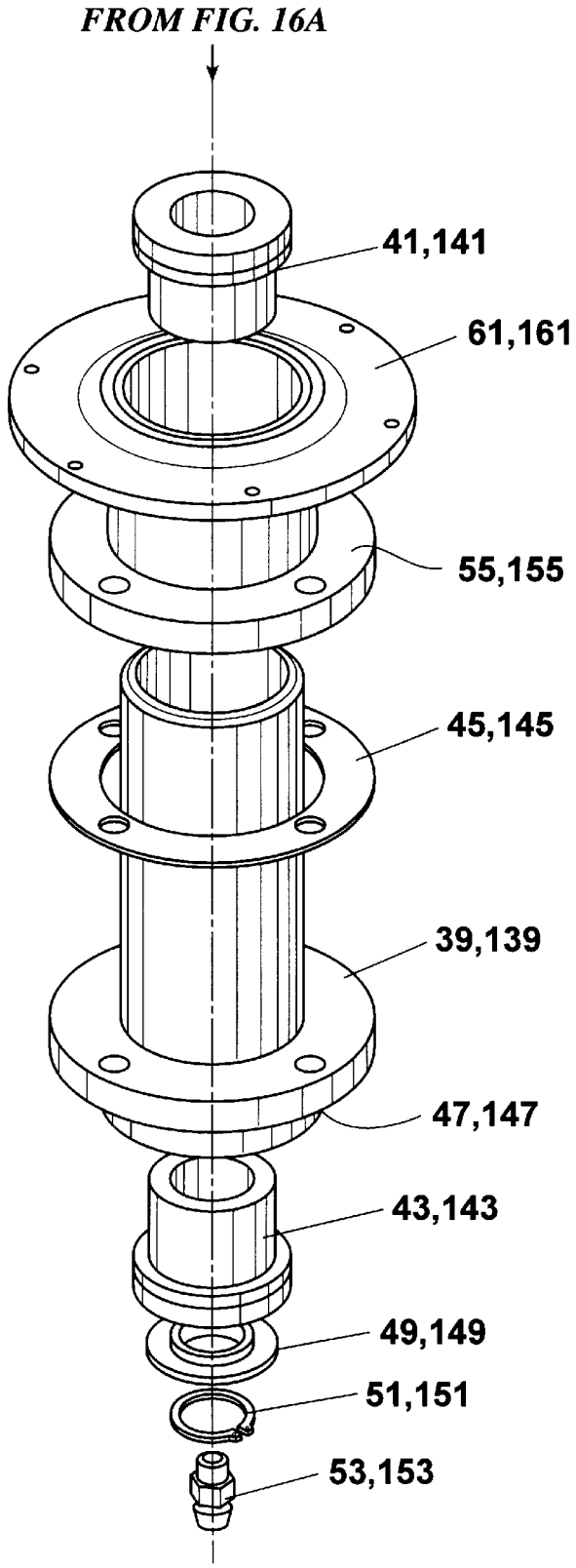
Figure 17:
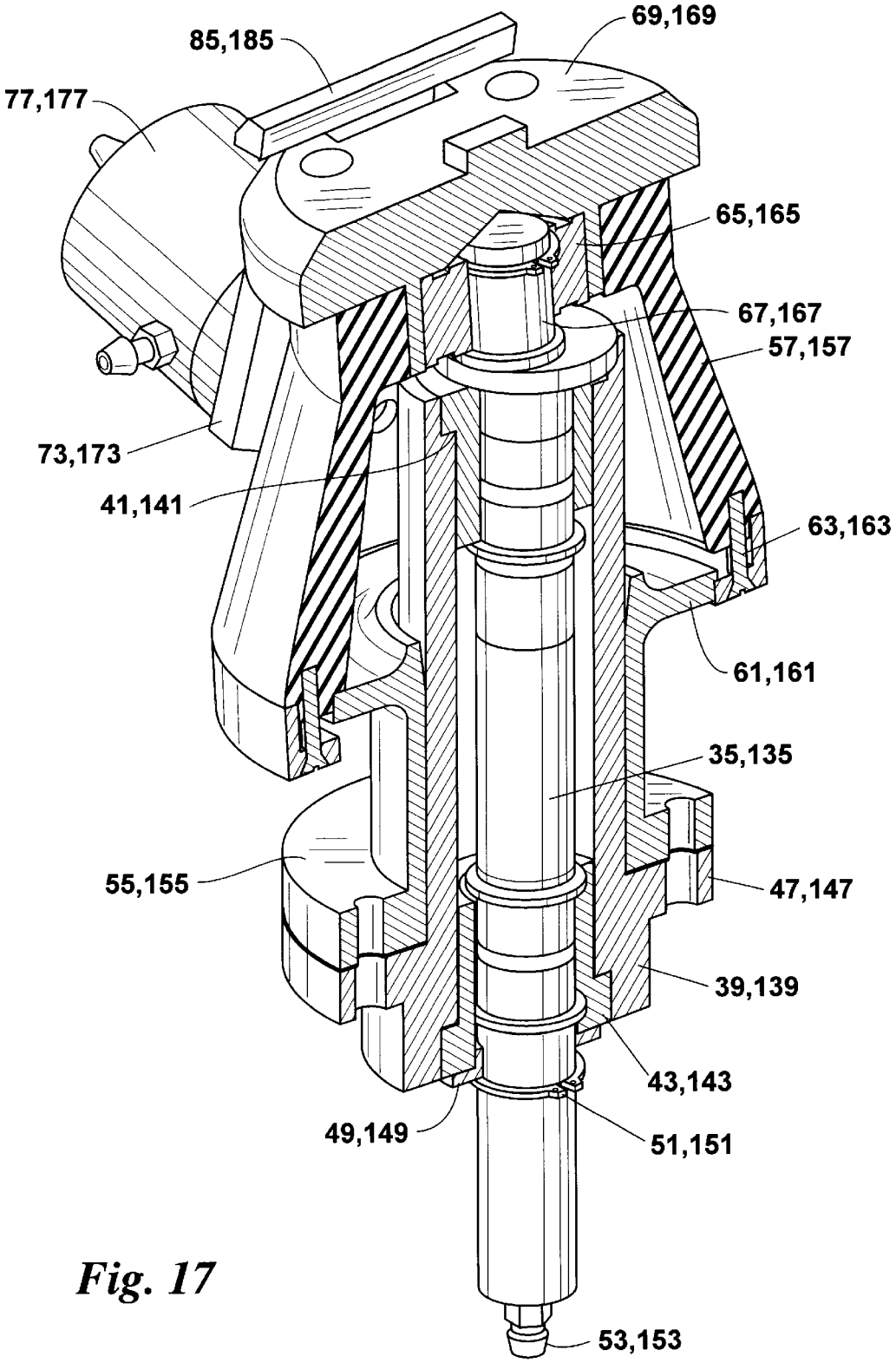
FIG. 17 is a perspective view with parts broken away of the assembled lap apron assemblies of FIG. 16.

The right and left lap apron assemblies 30 and 130 are illustrated in greater detail in FIGS. 16 and 17. The assemblies 30 and 130 have eccentric cam shafts 35 or 135 with the eccentric axes 31 or 131 being displaced from the rotational axes 33 or 133 by an angle 37 or 137 which is preferably approximately four degrees and provides a horizontal displacement of approximately ¼ inch. An orbital cam housing 39 or 139 has needle roller bearings 41 or 141 and 43 or 143 mounted in its upper and lower ends, respectively, in which the eccentric cam shaft 35 or 135 is rotatively mounted. A slurry bowl gasket 45 or 145 is seated on an annular flange 47 or 147 around the orbital cam housing 39 or 139. The lower bearing 43 or 143 is held in place by a bearing guide 49 or 149 and a retaining ring 51 or 151. A straight zerk 53 or 153 is connected to the lower end of the eccentric cam shaft 35 or 135 for admitting lubricant into the shaft 35 or 135 for the needle bearings 39 and 41 or 139 and 141. The orbital cam housing 39 or 139 is inserted into its respective aperture 561 or 563 in the base plate 531 with the top face of the flange 47 or 147 against the lower face of the base plate 531. A diaphragm mounting ring 55 or 155 slides over the upper portion of the orbital cam housing 39 and clamps the lap apron assembly 30 or 130 to the slurry bowl 527 with the gasket 45 or 145 providing the necessary seal. An apron shield 57 or 157 seated on an upper rubber flange 61 or 161 of the diaphragm mounting ring 55 or 155 is secured in place by a baffle ring 59 or 159 by screws 63 or 163. A double row ball bearing 65 or 165 mounted in the upper portion of the apron shield 57 or 157 rotatively holds the upper portion 67 and 167 of the eccentric shaft 35 or 135. The lap adapter 69 or 169 is secured to the top of the apron shield 57 or 157 by screws 71 or 171. The lap tool (not shown) will be located on the upper face of the lap adapter 69 or 169. A lap clamp lever 73 or 173 is pivotally connected to the lap adapter 69 or 169 by a lever pin 75 or 175 and an air cylinder assembly 77 or 177 is secured to the free end of the lap clamp lever 73 or 173 by screws 79 or 179. The lever 73 or 173 is provided with an aperture 81 or 181 and the air cylinder shaft (not shown) extends through the aperture 81 or 181 against a lap clamp shoe 83 or 183 mounted on the apron shield 57 or 157. Thus, with a lap tool (not shown) mounted on the lap adapter 69 or 169, the air cylinder assembly 77 or 177 can be operated to pivot the lap clamp lever 73 or 173 about the pivot pin 75 or 175 so that the clamping end 85 or 185 will secure the lap (not shown) in position on the lap adapter 69 or 169. As the eccentric shaft 35 or 135 rotates, the rubber flange 61 or 161 permits the lap adapter 69 or 169 to wobble without rotation.

Figure 18:
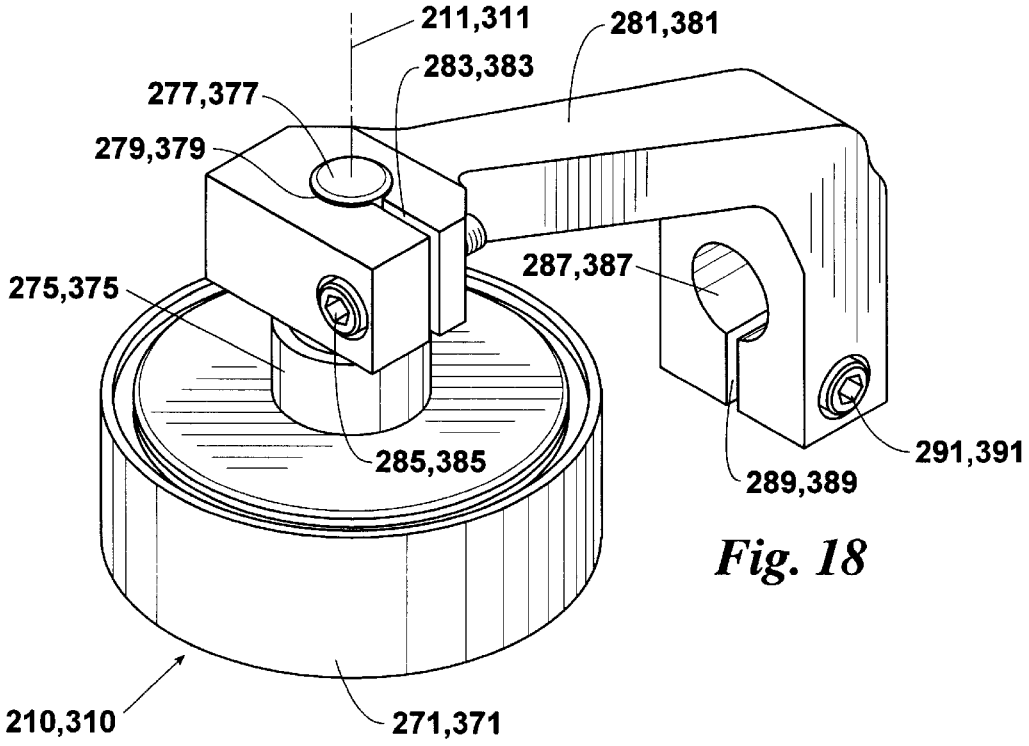
FIG. 18 is a front perspective view of preferred embodiment of the block adapter and rocker arm assembly of the machine of FIG. 2.
Figure 19:
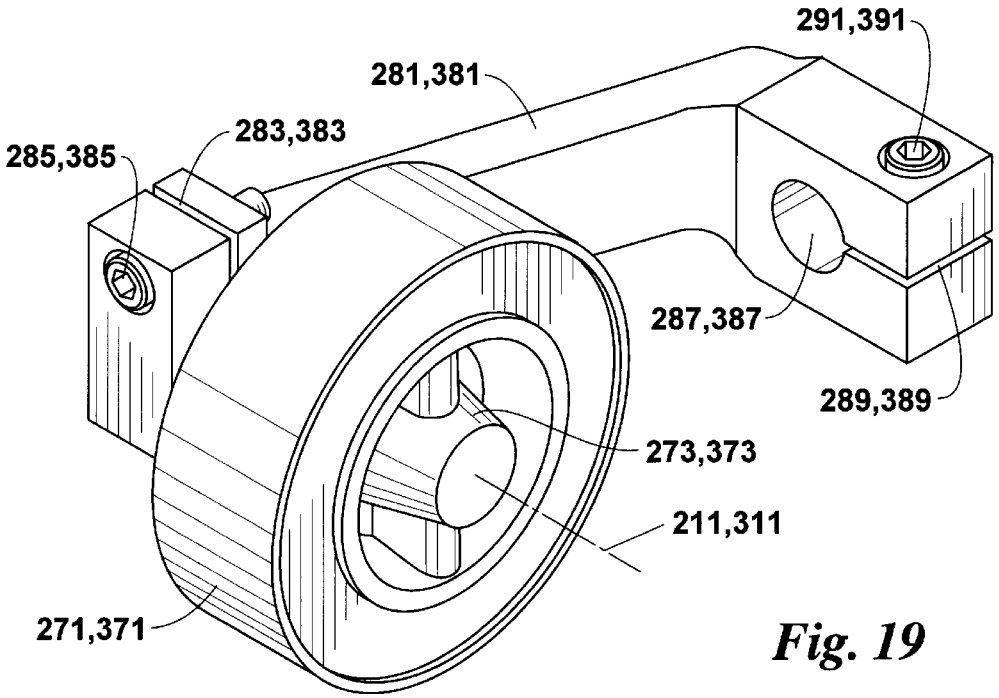
FIG. 19 is a bottom perspective view of the block adapter and rocker arm assembly of FIG. 18.

The right and left block adapter assemblies 210 and 310 are illustrated in FIGS. 18 and 19. The assembly 210 or 310 includes a housing 271 or 371 with a profile disk 273 or 373 centered in its bottom face for engagement with the blocked lens (not shown). The shaft 275 or 375 of the block adapter assembly 210 or 310 extends vertically upwardly from the block adapter assembly 210 or 310 on its central axis 271 or 371. The upper end 277 or 377 of the shaft 275 or 375 is mounted in an aperture 279 or 379 in the end of a long portion of a substantially J-shaped rocker arm 281 or 381. The end of the aperture 279 or 379 has a slot 283 or 383 extending to the outer wall of the rocker arm 281 or 381 with a screw 285 or 385 extending through the slotted portion to permit tightening or loosening of the aperture 279 or 379 on the shaft upper end 277 or 377. This permits adjustment of the height and rotational orientation of the block adapter assembly 210 or 310 in the rocker arm 281 or 381. The short leg of the J-shaped rocker arm 281 or 381 has a horizontally aligned aperture 287 or 387 through it with a slot 289 or 389 extending from the aperture 287 or 387 to the outer wall of this portion of the rocker arm 281 or 381. A screw 291 or 391 extending through this slotted portion permits loosening and tightening of the horizontal aperture 287 or 387. As can best be seen in FIG. 2, the aperture 287 or 387 in the short leg of the rocker arm 281 or 381 receives the front end of the rocker housing assembly shaft 231 or 331. Thus, the alignment of the vertical axis 211 or 311 of the block adapter assembly 210 or 310 can be adjusted in relation to the rotational axes 33 or 133 of the lap apron assembly 30 or 130 by loosening the horizontal aperture screws 291 or 391, sliding the rocker arm 281 or 381 to its desired position and retightening the screws 291 or 391.

Figure 21:
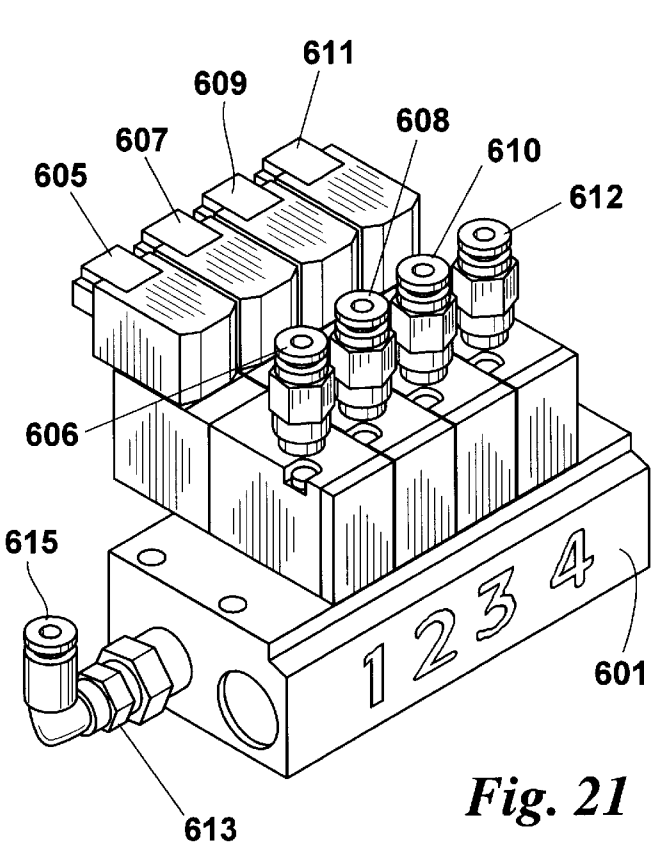
FIG. 21 is a perspective view of the assembled valve assembly of FIG. 20.
Figure 20:
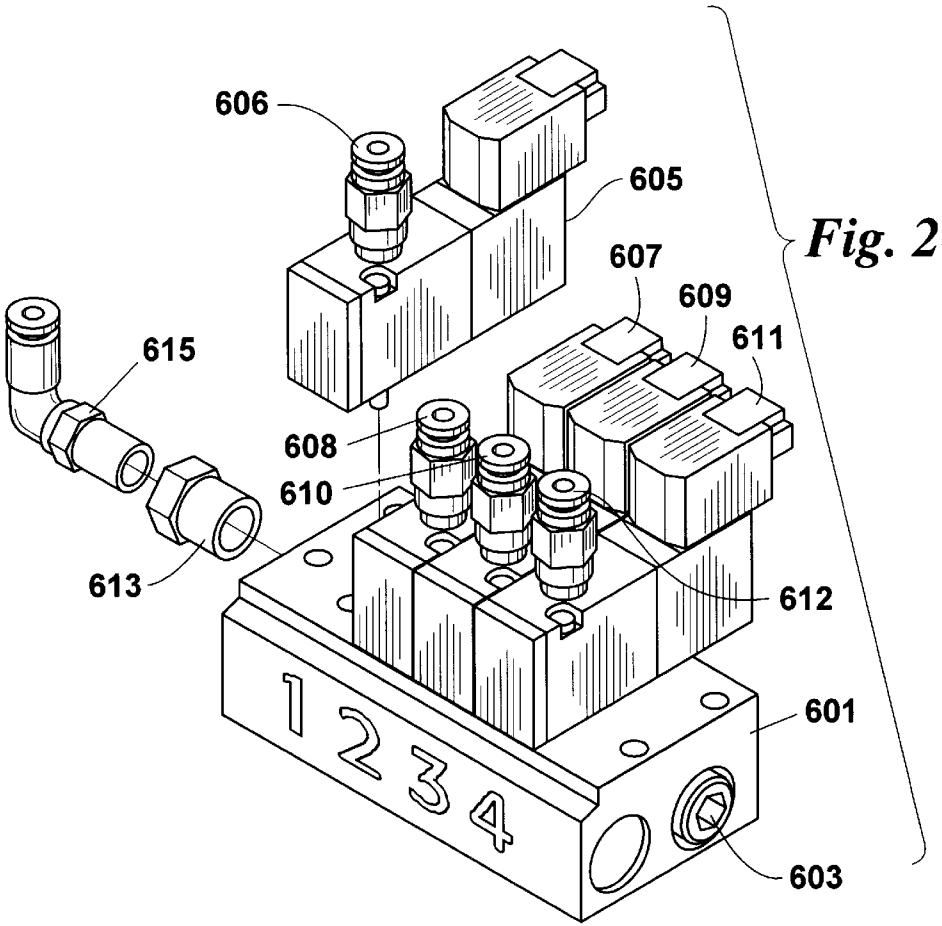
FIG. 20 is a perspective assembly view of a preferred embodiment of the valve assembly of the machine of FIG. 2.

The valve assembly of the pneumatic system illustrated in FIG. 3 is shown in greater detail in FIGS. 20 and 21. A valve manifold 601 has its outlet port sealed with a plug 603. Four three-way solenoid valves 605, 607, 609 and 611 having air outlet ports 606, 608, 610 and 612 are mounted on the manifold 601. A bushing 613 and fitting 615 are connected to the air inlet port of the manifold 601. Two of the solenoid valve air outlet ports 606 and 608 are connected to opposite sides of one of the rocker assembly cylinders 201 and the air outlet ports 610 and 612 of the remaining solenoid valves 609 and 611 are connected to opposite sides of the other rocker assembly cylinder 301. Thus the valve assembly controls the downward force of the block adapter assemblies 210 and 310.

Figure 23:
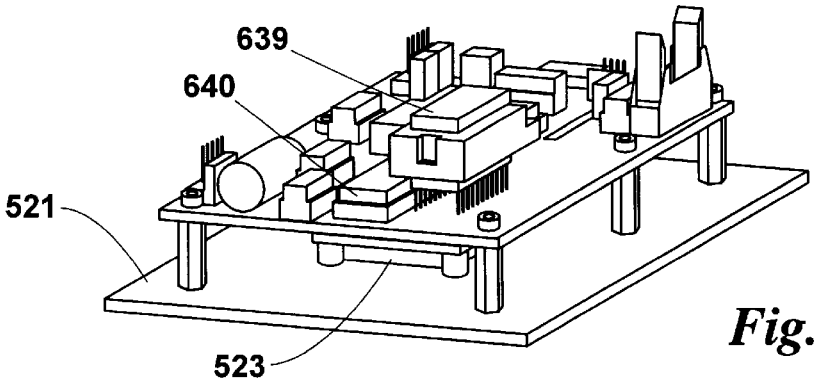
FIG. 23 is a perspective view of the assembled control panel assembly of FIG. 22.
Figure 22:
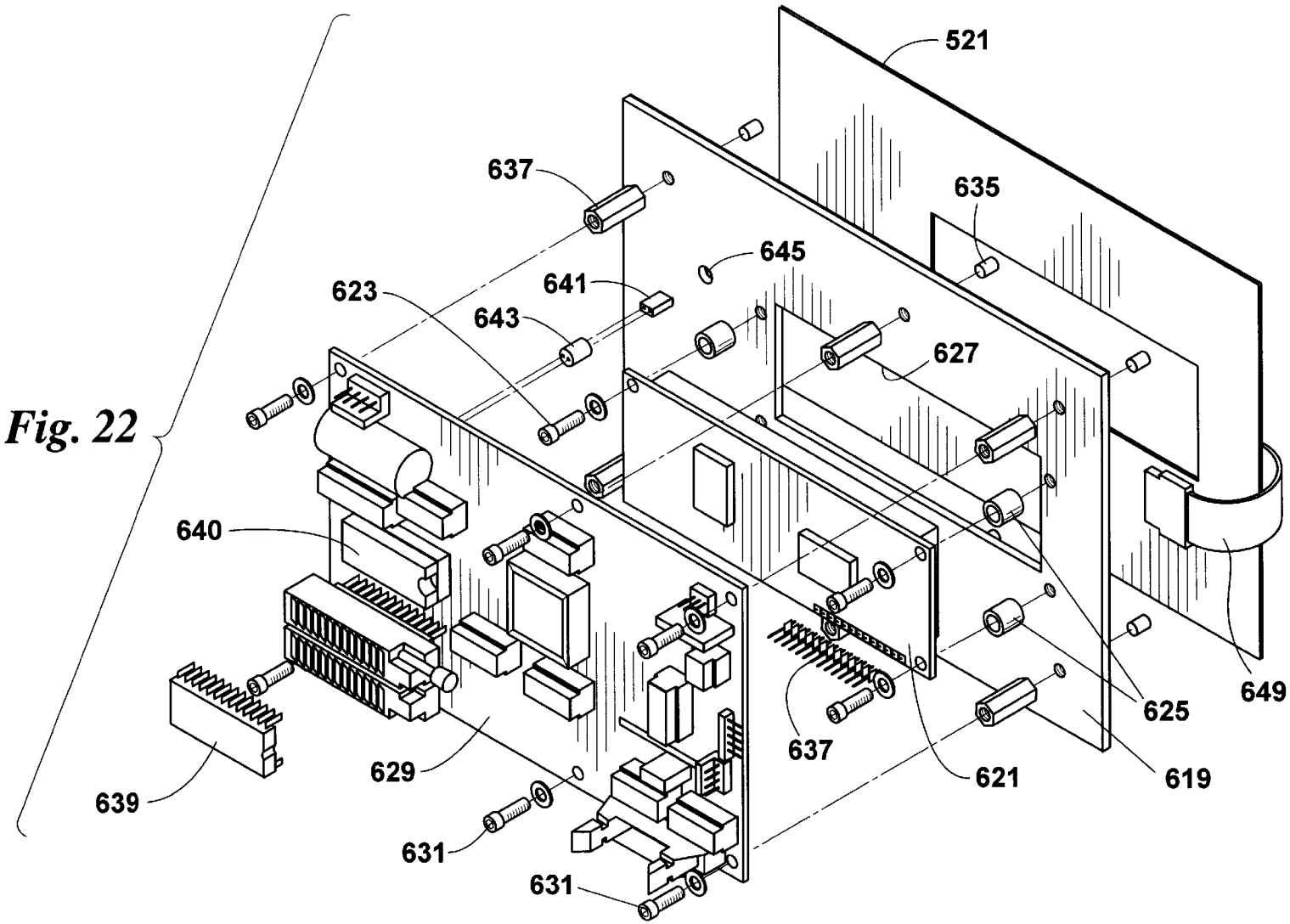
FIG. 22 is a perspective assembly view of a preferred embodiment of the control panel assembly of the machine of FIG. 2.

The control panel assembly is illustrated in FIGS. 22 and 23. The display PC board 621 is mounted to the back of a keyboard backing plate 619 by screws 623. PC board standoffs 625 position the LCD display 523 as shown in FIG. 2 within a viewing aperture 627 in the keyboard backing plate 619. An SBC control card 629 is fastened to the keyboard backing plate 619 by use of screws 631 threaded into longer standoffs 633 which are secured to the keyboard backing plate 619 by set screws 635. The SBC control card 629 connects to a male strip header 637 mounted on the back of the PC board 621 and includes an EPROM section 639 which stores the machine operating program and a non-volatile RAM section 640 which stores the pressure, time, cycle and other data needed to serve the needs of the user. An LED diode 641, preferably green, is mounted to SBC control card 629 by a spacer 643 and extends through an aperture 645 in the keyboard backing plate 619. A special key pad 521, also shown in FIG. 2, is mounted on the front face of the keypad backing plate 619 and is connected by a cable 649 to the SBC control card 629.

Figure 24:
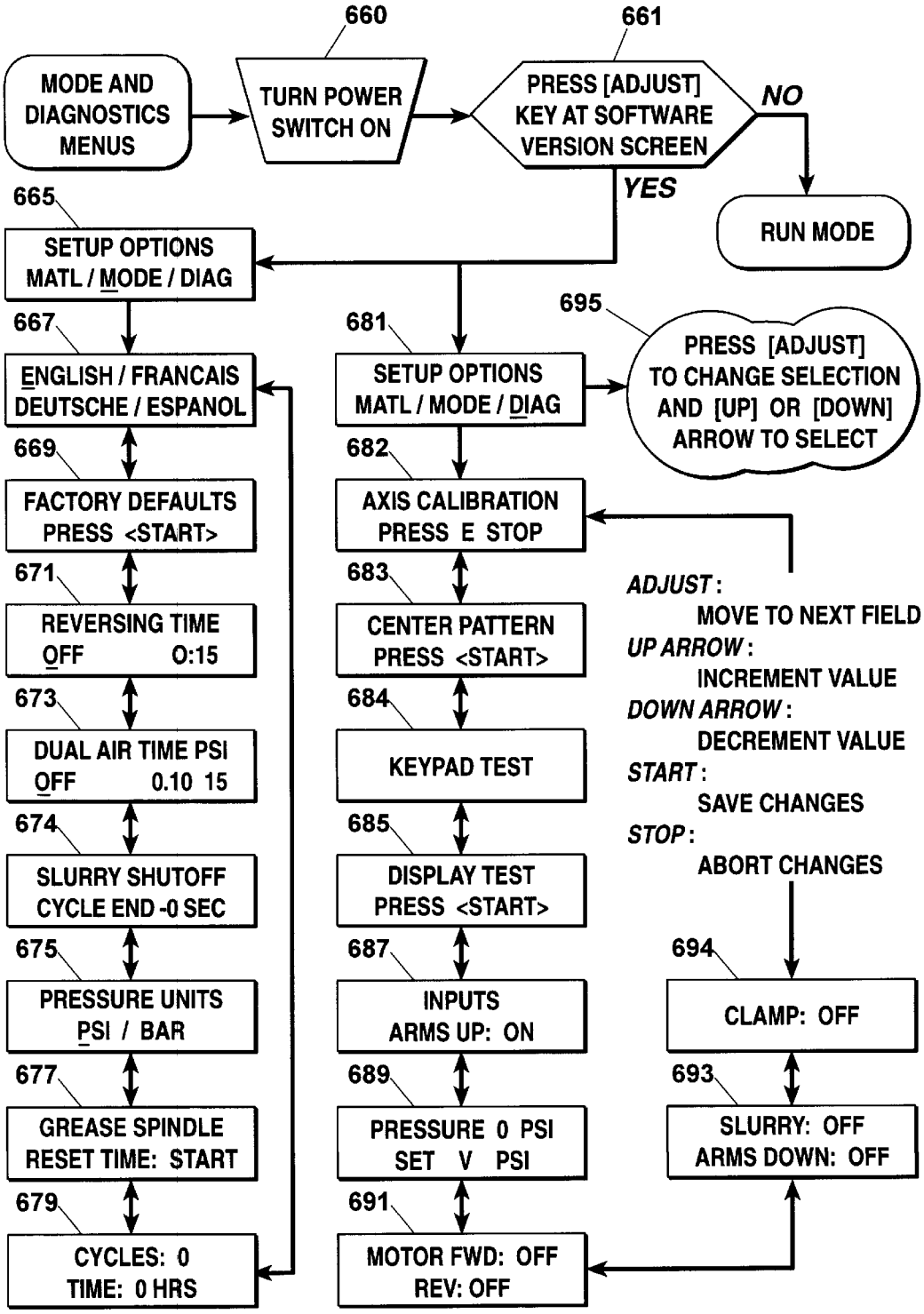
FIG. 24 is a flow diagram illustrating the mode and diagnostic options available to the machine operator.

Turning to FIG. 24, the MODE and Diagnostics menus are illustrated. The operator will first "turn power switch on" 660. If, within five seconds of the machine being turned on, the operator presses [adjust] key at software version screen 661, setup options MATL/MODE/DIAG 665, 681 and 697 are presented, one of which may be selected by cursor. If the operator selects the MODE 665 option, the operator can then sequentially select "English/Francais/Deutche/Espanol" 667, "factory defaults <press start>" 669, "reversing time" 671, dual air time PSI" 673, "slurry shut off" 674, pressure units 675, "grease spindle reset time" 677 and "cycle/time" 679. "Factory default <press start>" 669 establishes the time and pressure parameters and other variables to which the machine will return on shut off. "Reversing time" 671 allows switching of the rotational direction of the drive motor 451. "Dual air time PSI" 673 permits the operator to select two different pressures to be applied to the same lenses during a single cycle. "Cycle time" 679 indicates the accumulated number of cycles and hours a machine has been in operation. If the operator selects the diagnostics DIAG 681 option, the operator can then sequentially select "axis calibration" 682, "center pattern press <start>" 683, "keypad test" 684, "display test" 685, "inputs" 687, "pressure/set" 689, "forward or reverse motor" 691, "slurry" 693 or "clamp" 694 for diagnostic evaluations. In any of these options, the operator can "change selection" 695.

Figure 25:
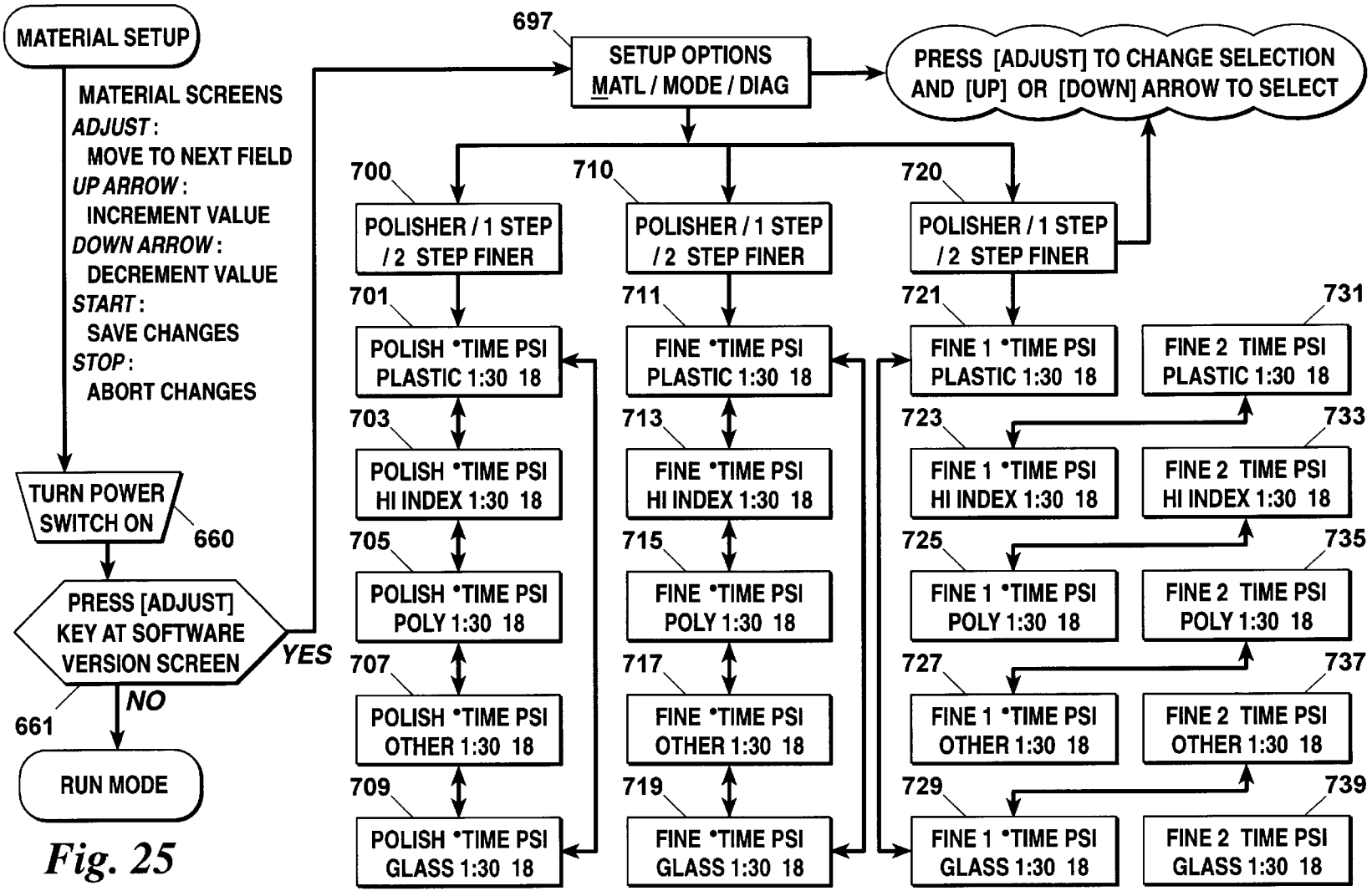
FIG. 25 is a flow diagram illustrating the lens material options available to the machine operator.

Turning to FIG. 25, the Material Setup menu is illustrated. If the operator selects the "MATL" 697 option, the operator then can select by cursor from the "POLISHER/ONE STEP/TWO STEP FINER" modes 700, 710 or 720. If the "polisher" 700 mode is selected, then the operator may select by cursor from five materials options including, as shown, "plastic" 701, "high index" 703, "poly" 705, "other" 707 or "glass" 709. If the "one step finer" 710 mode is selected, the operator then can select between "plastic" 711, "high index" 713, "poly" 715, "other" 717 or "glass" 719. If the "two step finer" 720 mode is selected, the operator then can select "plastic" 721 and 731, "high index" 723 and 733, "poly" 725 and 735, "other" 727 and 737 or "glass" 729 and 739. In various options presented in the Material Setup menu, the operator can select the time and pressure at each appropriate option, the pressure level being variable in 1 psi increments from 10 to 40 psi and the time being variable in 5 second increments up to 9 minutes, 55 seconds.

Figure 26:
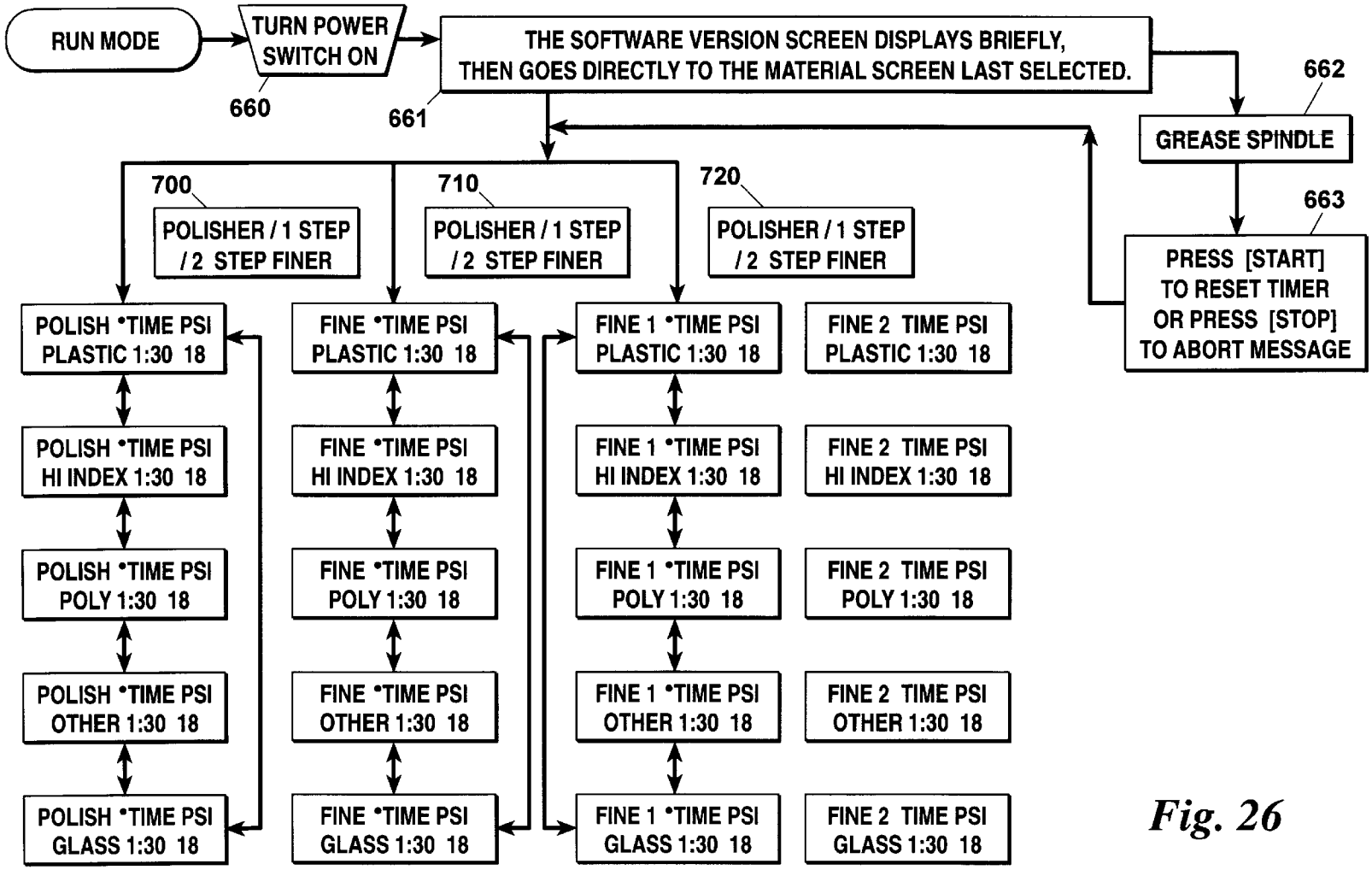
FIG. 26 is a flow diagram illustrating the emergency stop and machine malfunction options available to the machine operator.

If the operator does not "press [adjust]" 661 in the required time, the machine proceeds to a Run Mode as shown in FIG. 26. After the operator "turns power switch on" 660, "the software version screen displays briefly, then goes directly to the material screen last selected" 661. The fining/polishing modes 700, 710 and 720 as discussed in relation to FIG. 25 will then be presented for selection by the operator and the machine will operate accordingly. After the selected use time, at the end of a cycle the machine will display a "grease spindle" 662 notice. This notice will be redisplayed at the end of every cycle until the operator will "press [start] to reset timer or [stop] to abort the message" 663. If, during the operation of the machine, the emergency stop 519 is pressed, operation of the machine will be immediately terminated. When the emergency stop 519 is manually released, the machine will return to the software version screen. If the machine is turned off at the end of a cycle by use of the main power switch 517, the machine will return to the factory default parameters in the last selected mode of operation.

In operating the machine, the operator mounts the appropriate lap tool (not shown) on the lap apron input assemblies 30 and 130 and chucks the lenses to be fined/polished to the block adapter assemblies 210 and 310. The operator selects the appropriate machine and material types for the lenses to be fined/polished in accordance with the diagram of FIG. 25. This will set the preselected time and pressure parameters for the operation of the machine from the programmed parameters stored in the machine. These parameters can be reprogrammed by the operator if necessary. This can be done by use of the MODE 665 option shown in FIG. 24. With the machine ready to operate, pressing the start key on the keyboard 521 will cause the rocker arm cylinders 201 and 301 to apply the selected force to the block adapter assemblies 210 and 310. The lap clamps 85 and 185 are then closed by their air cylinders 77 and 177 and the slurry pump is started. The motor 451 is then engaged to begin rotation of the swing disk 403, the slide disk 409, and the shafts 35 and 135 of the lap apron assemblies 30 and 130. The rotation of the swing disk 403 and the slide disk 409 causes the block adapter assemblies 210 and 310 to move in figure eight patterns while the non-unity timing ratio causes the figure eight patterns to be laterally reciprocated. Looking at FIG. 7, it is preferred that the slide pulley 491 be a 43 tooth pulley while the swing pulley 417 is a 21 tooth pulley, so that the swing pulley 417 will have rotated one tooth more than two revolutions for each revolution of the slide pulley 491. The orbital motion of the lap apron assemblies 130 and 330 and reciprocating figure eight motion patterns of the block adapter assemblies 210 and 310 are imposed upon the lenses at the predetermined pressure exerted by the air cylinders 201 and 301 at the other end of the shafts 231 and 331 of the rocker housing assemblies 230 and 330. The surface to surface positioning of the lap (not shown) against the lenses (not shown) is facilitated by the rotation of the shafts 231 and 331 of the rocker housing assemblies 230 and 330 within the housings 230 and 330 which permits the block adapter assemblies 210 and 310 to float the lens contours on the laps. Because of the use of a single swing frame 400 mounted to the vertical plate 533 which is in turn fixed to the base plate 531 supporting the lap apron assemblies 30 and 130, machine calibration problems are greatly reduced in comparison to previously known machines. Once the linkages 407 and 413 have been adjusted to length, fine tuning can be accomplished by the operator through the machine access door 515 by adjusting the level of the block adapter assemblies 210 and 310 by repositioning the block adapter assembly shafts 271 and 371 in the bracket arms 261 and 361 and by changing the horizontal positioning of the bracket arms 261 and 361 on the rocker shafts 231 and 331.

Thus, it is apparent that there has been provided, in accordance with the invention, a fining/polishing machine that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A machine for fining/polishing ophthalmic lenses comprising:

a horizontal plate;

a vertical plate rigidly fixed to said horizontal plate and extending upwardly from a midportion thereof;

means mounted on said horizontal plate for orbiting a first tool about a first vertical axis on one side of said vertical plate;

means mounted on said horizontal plate for orbiting a second tool about a second vertical axis on said one side of said vertical plate, said first and second vertical axes being in a plane parallel to said vertical plate;

a swing frame pivotally mounted on another side of said vertical plate and having a horizontal shaft parallel to said vertical plate;

a first shaft orthogonal to said horizontal shaft journalled for see-saw motion about said horizontal shaft, for rotational motion about a longitudinal axis of said first orthogonal shaft and for sliding motion along said horizontal shaft, said first shaft extending through an aperture in said vertical plate with said longitudinal axis intersecting said first vertical axis and said first shaft having means on an end thereof for holding a first lens in vertical alignment above the first tool;

a second shaft orthogonal to said horizontal shaft journalled for see-saw motion about said horizontal shaft, for rotational motion about a longitudinal axis of said second orthogonal shaft and for sliding motion along said horizontal shaft, said second shaft extending through an aperture in said vertical plate with said longitudinal axis intersecting said second vertical axis and having means on an end thereof for holding a second lens in vertical alignment above the second tool;

means for reciprocally moving said horizontal shaft in parallel relationship to said vertical plate; and means for simultaneously reciprocally moving said first and second orthogonal shafts in orthogonal relationship to said vertical plate, said horizontal shaft and orthogonal shafts moving means having a timing ratio therebetween such that said first and second lens holding means travel in horizontal figure eight patterns aligned with said first and second orthogonal shafts and said first and second lens holding means reciprocating in a direction parallel to said vertical plate.

2. A machine according to claim 1, further comprising a single drive means coupled to said horizontal and orthogonal shaft moving means.

3. A machine according to claim 1, said lens holding ends of said first and second orthogonal shafts having means thereon permitting for independent adjustment of lengths thereof to permit horizontal realignment of said first and second lens holding means.

4. A machine according to claim 1, said lens holding ends of said first and second orthogonal shafts having means thereon permitting independent adjustment to permit vertical realignment of said first and second lens holding means.

5. A machine according to claim 1, said timing ratio providing slightly more than two reciprocations of said horizontal shaft for each reciprocation of said orthogonal shafts.

6. A machine according to claim 1, said orbiting means causing the first and second tools to orbit in opposite directions.

7. A machine according to claim 1, said simultaneous reciprocating means causing said first and second shafts to move in opposite directions.

8. A machine according to claim 1 further comprising first and second means connected to opposite ends of said first and second orthogonal shafts as said lens holding means for causing said first and second orthogonal shafts to seesaw to maintain a desired pressure between the tools and the lenses.

9. A machine according to claim 8 further comprising a microprocessor having data stored therein representative of appropriate times of operation of the machine and pressures between the tools and lenses for a plurality of lens materials and fining/polishing operations for automatically setting and controlling a time of operation of the machine and a pressure between the tools and lenses in response to input to said microprocessor of a selected lens material and a selected fining/polishing operation.

* * * * *